US011826978B2

(12) United States Patent
Gonzalez Olmos

(10) Patent No.: US 11,826,978 B2
(45) Date of Patent: Nov. 28, 2023

(54) METHOD AND MACHINE FOR FORMING CARDBOARD BOXES BY GLUING, COMPUTER PROGRAM, AND COMPUTER-READABLE DEVICE THAT HAS STORED SAID PROGRAM

(71) Applicant: TELESFORO GONZALEZ MAQUINARIA S. L. U., Elche (ES)

(72) Inventor: Telesforo Gonzalez Olmos, Santa Pola (ES)

(73) Assignee: TELESFORO GONZALEZ MAQUINARIA S.L.U., Elche (ES)

( * ) Notice: Subject to any disclaimer, the term of this patent is extended or adjusted under 35 U.S.C. 154(b) by 0 days.

(21) Appl. No.: 17/313,027

(22) Filed: May 6, 2021

(65) Prior Publication Data

US 2021/0347138 A1 Nov. 11, 2021

(30) Foreign Application Priority Data

May 7, 2020 (ES) ..... 202030402

(51) Int. Cl.

| | |
|---|---|
| ***B31B 50/00*** | (2017.01) |
| ***B31B 50/06*** | (2017.01) |
| ***B31B 50/62*** | (2017.01) |
| ***B31B 50/44*** | (2017.01) |
| *B31B 100/00* | (2017.01) |

(52) U.S. Cl.

CPC ..... *B31B 50/006* (2017.08); *B31B 50/06* (2017.08); *B31B 50/44* (2017.08); *B31B 50/624* (2017.08); *B31B 2100/00* (2017.08)

(58) Field of Classification Search

CPC ..... B31B 50/006; B31B 50/06; B31B 50/624; B31B 50/44; B31B 2100/00; B31B 50/02; B31B 50/10

USPC ..... 493/127

See application file for complete search history.

(56) References Cited

U.S. PATENT DOCUMENTS

| | | | | |
|---|---|---|---|---|
| 3,955,482 | A | 5/1976 | Moen | |
| 4,604,083 | A * | 8/1986 | Barny | B31B 50/006 493/34 |
| 4,847,775 | A * | 7/1989 | Roch | B65H 45/28 700/125 |

(Continued)

FOREIGN PATENT DOCUMENTS

| | | |
|---|---|---|
| ES | 2531301 B1 | 12/2015 |
| ES | 258673381 B1 | 7/2017 |

*Primary Examiner* — Sameh Tawfik
(74) *Attorney, Agent, or Firm* — Bay State IP, LLC

(57) ABSTRACT

A method to form cardboard boxes by gluing into a box-forming machine from sheets, said machine, a computer program with instructions for said machine to execute said method, and a computer-readable device that has stored said computer program. In this method, a stage of the movement of inserting a pintle into a mold starts with a controlling element when the position of a drag element of sheet to a delivery position, where you place a sheet aligned between said pintle and mold, it corresponds to a second intermediate position between a source position and said delivery position; and a stage of activation of a supplying actuator starts with a controlling element to supply a sheet subsequent to the source position, when the position of said drag element corresponds to a third intermediate position between said source position and said second position.

24 Claims, 13 Drawing Sheets

(56) References Cited

U.S. PATENT DOCUMENTS

| | | | | |
|---|---|---|---|---|
| 5,177,930 | A * | 1/1993 | Harston | G05B 19/416 53/506 |
| 5,827,162 | A * | 10/1998 | Rubin | B31B 50/56 493/34 |
| 6,358,191 | B1 | 3/2002 | Greever | |
| 6,691,997 | B2 * | 2/2004 | Chiari | B65H 29/044 271/3.04 |
| 8,640,579 | B2 * | 2/2014 | Pedercini | B26D 5/32 83/13 |

* cited by examiner

METHOD AND MACHINE FOR FORMING CARDBOARD BOXES BY GLUING, COMPUTER PROGRAM, AND COMPUTER-READABLE DEVICE THAT HAS STORED SAID PROGRAM

TECHNICAL FIELD

The present invention presents a method to form cardboard boxes by gluing in a machine that forms boxes from sheets. In a second aspect, the invention provides a machine configured to execute said method to form cardboard boxes by gluing from sheets. According to a third aspect, the invention provides a computer program for said machine to execute said method. In a fourth aspect, the invention provides a computer-readable device that has stored said computer program.

Throughout this description, said sheets correspond to semi-rigid flat sheets of cardboard, such as corrugated cardboard, compact cardboard, and the like, die-cutting, endowed with cutting lines, and weakened lines of cleft and/or cleft cutting.

STATE OF THE ART AND TECHNICAL PROBLEM TO BE SOLVED

Documents ES2531301B1 and ES2586733B1 disclose automatic cardboard box-forming machines comprising a molding slot, a flat sheet feeder that places cardboard sheets one by one in a delivery position over said slot, and a pintle that, when moved by a drive in a linear direction of insertion, presses a part of the sheet into said slot, causing bending of different parts of the sheet in cooperation with benders of the molding slot to form the box. The pintle is then displaced by said drive in a linear direction of extraction out of the slot to a position of extraction ready to initiate a subsequent box-forming cycle.

Said feeder comprises a stacked-sheets loader and a supplier that takes a sheet from the loader, for example, the flat sheet on the lower level of the stack, and positions it on conveyor guides. Said feeder also comprises said conveyor which moves the sheet along those guides to said delivery position over said molding slot. Generally, said conveyor comprises an auger drag chain mounted on pulleys, a drag element attached to the drag chain, and an electric motor that rotates one of the pulleys to move the drag chain.

Document ES2531301B1 discloses a pintle drive with a rotating electric motor, and a reducer, and some means to control the machine. These means of control allow to regulate the limit positions of the insertion and extraction of the pintle, as well as its course, in addition to optional downtimes in which the pintle remains stopped in the limit position of extraction and/or in the limit position of insertion and/or in any other intermediate position, to adapt the machine to different types of boxes of sheet material. These means of control, together with the specific mechanical solution of the pintle drive simplify the coordination of the movements of the pintle drive with other moving elements of the machine.

Document ES2586733B1 addresses the problem of precisely controlling the movements of the pintle drive in coordination with the movements of the sheet feeder, using means of control with respective servo motors and servo motor controllers connected to a programmable logic controller (PLC). Such means of control include sensors 54, 55 connected to the PLC that detect the limit positions of the insertion and extraction of the pintle, a sensor 53 to detect a pre-determined position of a drag element 36 in said feeder, and timers programmed in the PLC cause the pintle to start and stop with respect to a certain cycle start condition, for example, when the pintle is detected to reach its limit position of extraction. Said PLC has outputs 52 connected to the conveyor and pintle servo motors, connected in turn to respective servo motor controllers, and about 15 outputs connected to relays that open and close solenoid valves of glue injectors to apply glue to the sheet before it is inserted into the slot.

On the other hand, document U.S. Pat. No. 6,358,191B1 discloses a control system for a cardboard box-forming machine, a method for controlling said machine, and a computer program stored on a processor-readable device that contains instructions for executing said method. The machine includes a controller, such as a PLC, a microprocessor, computer or equivalent, to control the operation of the machine elements, and a user interface attached to the controller that allows the user to enter a plurality of box types. The controller is programmed to store control information describing operational parameters for machine elements for each type of box, to monitor signals indicating the position of the sheet during its movement through the forming machine, to generate control signals of the machine elements based on operational parameters for the selected box type, so that the forming machine forms one or more boxes of the selected type.

The U.S. Pat. No. 6,358,191B1 forming machine comprises a rotational encoder (encoder) and said controller is programmed to monitor the output signal of said encoder, which represents the current point in the operating cycle. Thus, the encoder causes the PLC to activate the machine elements if the current encoder signal is within the range of the values previously saved on the controller. The control signals generated by the encoder are to activate the glue injectors and to activate the cylinders that close the flaps of the box.

On the other hand, document U.S. Pat. No. 3,955,482A discloses a method and control system for a box-forming machine by melting sheets of expanded thermoplastic material coated with a thermoplastic layer using heat welding. Said layer is melted with heaters that join some parts of the sheet with each other and form said box. Said control system synchronizes the swing of the pintle and conveyor by means of a cylinder valve moving the conveyor, a cylinder valve that moves the pintle, an adjustable timer, a stopped sheet detector 144 with an arm 156 and a detector 146 that raises the pintle from a limit position of insertion to a limit position of extraction.

The method described in U.S. Pat. No. 3,955,482A keeps the drag element in the source position, for a pre-set time manually set on said timer, to give time for the box of the previous cycle to form in the pintle and molding area and, and to wait for the pintle to reach a position of extraction ready for a subsequent cycle formation. After exceeding this pre-set time, the timer closes a contact that moves the drag element, which positions the sheet of the subsequent cycle in the delivery position over the slot aligned with the pintle. With the sheet in the delivery position, said detector 144 detects the front edge of the sheet and simultaneously moves the pintle to the insertion position and the drag element to the source position of the conveyor. When the pintle inserts the sheet into the mold, detector 144 stops detecting the sheet and causes the timer to start counting said pre-set time again. When the pintle is inserted, detector 146 moves the pintle to the maximum position of extraction, after which another automatic cycle is initiated after exceeding the pre-set time of the timer.

Disadvantageously, the use of a pneumatic cylinder as an actuator on the U.S. Pat. No. 3,955,482A conveyor does not allow to know the position of the sheet throughout its transport between the positions of origin and delivery to be able to apply the glue cords on precise positions of the sheets, so that the speed of the machine is very limited.

The heat welding bonding technology of the U.S. Pat. No. 3,955,482A is very different from the glue bonding technology of the ES2531301B1, ES2586733B1, and U.S. Pat. No. 6,358,191B1, usually also referred to as fast gluing by hot glue or "hot-melt" glue, as the times required for the application of the bond and the control for said bond to be effective are very different in each technology due to vanous differences: the cooling time of the heat welding by melting expanded thermoplastic material is very different from the cooling and drying time of the glue on a cardboard sheet, the application of heat has a very low speed compared to the application of glue cords, and the bonds by welding and gluing occur at different stages of the box-forming process.

These documents, separately or in combination, do not indicate or propose any method, or any box-forming machine implementing said method, or a computer program based on said method, to increase the number of boxes produced per unit of time in box-forming machines by gluing, even if the types or measures of the sheets to be converted into boxes change, by coordinating the controllable elements in those machines.

U.S. Pat. No. 6,358,191B1 is considered the nearest state of the art document.

The technical problem to be solved is to increase the speed of production of boxes in box-forming machines of different sizes by gluing in a simple and efficient way.

EXPLANATION OF THE INVENTION

According to a first aspect, the present invention provides a method to form cardboard boxes by gluing in a box-forming machine from sheets, helping to solve the above and other drawbacks.

Said method includes, in a way known in the state of art, the following stages:

(a) to receive, in a computer-programmable controller element, operational values for a determined type and measurement of a box to be formed sent from a user interface;

(b) to activate a supplying actuator of a supplying mechanism, by means of a controlling element, by sending an indicative signal from said controlling element to said supplying actuator, to supply a sheet from an initial position where it is supported in a loader of stacked sheets to a source position;

(c) to move a drag element to drag said sheet, sending an indicative signal from a computer-programmable controller element to a rotating motor operationally coupled to said drag element, along positions according to a linear direction of drag, associated with respective sheet positions, from said source position to a delivery position, where said sheet is located between a pintle and a mold, with a plurality of forming elements, each activatable by means of a respective actuator, arranged around a slot where said pintle is insertable;

(d) to continuously read the position of said drag element associated with the position of said sheet during stage (c), in a computer-programmable controller element:

(e) to activate glue injectors, to deposit parallel hot-glue cords on said sheet during stage (c), sending respective indicative signals from a computer-programmable controller element to each of the glue injectors, when the position of said drag element read in stage (d) coincides with one or more of the respective preset initial positions included in the respective sets of preset activation positions of each of said glue injectors, programmable and previously received at stage (a);

(f) to move said pintle according to a sense of linear insertion, from a position of extraction, to allow said sheet to be positioned in the delivery position, and toward an insertion position, where said pintle is inserted into said slot, by sending an indicative signal from a computer-programmable controller element to a rotating motor of a pintle drive configured to steer said pintle;

(g) to press, by said pintle during said stage (f), a portion of said sheet arranged between said slot and pintle in the position of delivery to the inside of the slot, where said pintle and said mold form the box by bending and bonding by gluing and pressuring different parts of said sheet with others; and (h) to move said pintle, according to a sense of extraction contrary to said sense of insertion, from said position of insertion to that position of extraction, by sending an indicative signal from a computer-programmable controller element to a rotary motor of a pintle drive configured to steer said pintle.

Similarly, said method includes, in a way not known in the state of art, the following characteristics:

said stage (f) is initiated by said controller element when the position of said drag element read at stage (d) corresponds to a second intermediate position between those source and delivery positions, with said second position being defined by a programmable operational value previously entered by a user in a user interface; and said stage (b) is started again by said controller element, in order to supply a subsequent sheet to said previous sheet, where the position of said drag element read at the stage corresponds to a third intermediate position between said source position and said second position, with said third position being defined by a programmable operational value previously introduced by a user in a user interface.

The present invention proposes to solve the technical problem of increasing said speed of said formation of boxes by synchronizing the movements between the different moving elements of the machine to eliminate unnecessary downtime within a certain formation cycle and/or between consecutive cycles of formation, which reduce the speed of the machine. Specifically, downtime is synchronized and eliminated between the movements of the drag element, the pintle, and the supplying mechanism in a differential way to the state-of-the-art to increase production speed.

With this synchronization, it is also possible for the pintle to press the sheet just when the sheet is positioned in the delivery position, and that this pressure is also performed with the pintle with a relative high speed in the initial and posterior impact against the sheet in order to reduce the time of movement of the pintle during his movement of insertion, as the pintle can start from a position of extraction located at a distance from the sheet in the delivery position according to the linear direction of the movement of the pintle, and the travel time of this distance to provide speed to the pintle during pressure does not add up to any downtime since this movement of the pintle occurs simultaneously during stage (c).

In addition, advantageously, the speed in the sheet pressure is relatively high because during the travel of this prior distance to the pressure of the sheet, which does not add any additional time to the box formation cycle, the initial low speed of the pintle movement has been gradually increased from zero due to inertia of the pintle and the pintle drive.

According to a preferred option, in said method said stage (d) of continuously reading also includes the stage of reading in said controller element said indicative signals sent by said controller element to the rotating motor at said stage (c), and optionally, converting them in said controller element said sent indicative signals read in positions of a drag element.

According to an alternative preferred option, in said method said stage (d) of continuously reading also includes the stage (v) of receiving in said controller element signals indicating the position of said drag element from a rotational encoder connected to the rotary motor.

Preferably, said method also includes the stage of rotating said rotating motor in the same direction during said stage (c), which is operationally coupled to an auger flexible transmission element where said drag element and other dragging elements are mounted at mutually opposite ends, by means of a signal sent from a computer-programmable controller element to said rotary motor, moving said two drag elements in opposite directions of the linear drag direction, alternating between the source and delivery positions, synchronizing the movement of the drag element of said stage (c) with the movement of the other drag element that does not drag sheet from the delivery position to the source position to drag a subsequent sheet.

With this, the speed of said box formation increases by synchronizing more moving elements of the machine eliminating unnecessary downtime in a simple and efficient way. Said speed also increases thanks to one element being in proximity to the source position when the other drag element keeps the sheet in the delivery position, which does not introduce downtime related to the translation of the drag element to the source position, while allowing the drag movement of the sheet in stage (c) to be performed at higher speeds without affecting the correct positioning of the sheet in said delivery position nor the precise deposition of the glue cords on the sheet in stage (e).

In a first preferred option of said method, said second position (P2) is defined by a corresponding operational value with a second programmable preset position (P2*x*) of the drag element (11), previously received at stage (a).

Alternatively, in a second preferred option of said method, where said second position is defined by a corresponding operational value with a preset complementary time period, positioning the drag element in said second position after stage (i) of having in a computer-programmable controller element said preset complementary time period of programmable duration, starting to count said preset complementary time period after detecting, in a computer-programmable controller element, a position of the drag element dragging the sheet or a position on the front or rear of said sheet in a second previous position, intermediate between said source position and said second position.

According to an option of this second preferred option, the detection in the second previous position is performed by reading in said controller element such indicative signals sent by the controller element itself to the rotary motor at said stage (c), and optionally, converting them in said controller element said sent indicative signals read in positions of a drag element.

According to an alternative option of this second preferred option, the detection in the second previous position is performed by reading in a computer-programmable controller element an indicative signal from a sheet detector.

According to a third option of said method, said third position is defined by a corresponding operational value with a third programmable preset position of the drag element, previously received at stage (a).

Alternatively, in a fourth option of said method, said third position is defined by a corresponding operational value with a preset auxiliary time period, positioning the drag element in said third position after stage (j) of having in a computer-programmable controller element said preset auxiliary complementary time period of programmable duration, starting to count said preset auxiliary complementary time period after detecting, in a computer-programmable controller element, a position of the drag element dragging the sheet or a position at the front or rear of said sheet in a third previous position, intermediate between said source position and said third position.

According to an option of said fourth option of said method, the detection of said third previous position is carried out by reading in said controller element said indicative signals sent by the controller element itself to the rotary motor at said stage (c), and optionally, converting them in said controller element said sent indicative signals read in positions of a drag element.

According to an alternative option of said fourth option of said method, said detection of said third previous position is carried out by reading in a computer-programmable controller element an indicative signal from another sheet detector.

With this, the speed of said formation of boxes increases thanks to the simplicity and efficiency of the start of the movement of the pintle with respect to the movement of the drag element and supplying actuator.

Preferably, this method also includes the following stages:

(k) to detect a change in the position of the pintle from a position of extraction, receiving in a computer-programmable controller element an indicative signal sent by a pintle position detector device, or reading in said computer-programmable controller element said indicative signal sent by the computer-programmable controller element to said rotary motor that moves the pintle in stage (f); and (l) to activate such actuators of said forming elements, sending an indicative signal from a computer-programmable controller element to those actuators, after stage (m) of having in said controller element a preset secondary time period of programmable duration previously received in stage (a), starting to count said secondary time period preset after stage (k).

Also, preferably, in said method:

said stage (c) starts again, to drag a subsequent sheet to said previous sheet, after stage (n) of having through a computer-programmable controller element a preset time period of programmable duration previously received in stage (a), starting to count said preset time period after stage (k);

and said method also includes the stage of maintaining one of those drag elements in said delivery position during stage (n).

As both the first and second preset time periods are referenced with respect to the change of position of the pintle with respect to the position of extraction, the time adjustment for the different sheet measurements to achieve respective maximum box formation speeds is achieved easily and effectively.

Preferably, this method also includes the following stages:

(p) to detect said pintle in said insertion position, receiving in a computer-programmable controller element an indicative signal sent by a pintle position detector device, or reading in said computer-programmable controller element said indicative signal sent by said computer-programmable controller element to the rotary motor at said stage (f); and (q) to keep said pintle in said insertion position by a controlling element, after stage (p) and for a set auxiliary time period of programmable duration, previously received at said stage (a):

where said stage (h) starts after stage (r) of having said preset auxiliary time period in a controller element, starting to count said preset auxiliary time period after said stage (p).

This allows to control the duration of the pressure time of the glue bonding, that is the time the pintle and the mold press some parts of the sheet glued with others to allow time for said applied glue cords to reduce their temperature and thus the union between said parts are permanent after their formation, to achieve respective maximum formation speeds for each ambient temperature condition, humidity, and glue and sheet specifications at the gluing junction.

Also, preferably, according to a first variant of said method:

at said stage (c) the drag element is moved at a fixed nominal speed, sending a binary signal from the controller element to said rotary motor, coupled to a rotational encoder; and said stage (d) includes the stage of receiving in said controller element signals indicating the position of a drag element (11) sent by said rotational encoder.

Preferably, according to a second variant of said method:

in said stage (c) said rotary motor moves the drag element, on the basis of a programmable preset desired speed indicator, introduced by a user into the user interface, prior to stage (a), from a plurality of non-zero selectable speeds, by sending signal signals from said controller element to an engine speed controller connected to said rotary motor:

said stage (d) includes the stage (s) of reading in said controller element such indicative signals sent by said controller element to the rotary motor at said stage (c), and stage (t) of converting, in said controller element, the indicative signals read at said stage (s) into positions of a drag element; and said method also includes stage (u) of setting the position of the drag element to a source value after each detection, in a drag element position detector, of a drag element at said source position.

Preferably, according to a third variant of said method:

in said stage (c) said rotary motor moves the drag element, based on a programmable preset desired speed indicator, introduced by a user into the user interface prior to stage (a) from a plurality of nonzero selectable speeds, sending indicative signals from said controller element to an engine speed controller connected to said rotary motor and to a rotational encoder; and said stage (d) comprises stage (v) of receiving in said controller element signals indicating the position of a drag element from said rotational encoder.

In these second and third variants, said motor speed controller comprises a speed controller of various types, such as, a frequency inverter or a servo motor controller, among others. Similarly, in these second and third variants, said rotary motor comprises a conventional electric rotary motor or servo motor, optionally equipped with a gearbox, among other options.

Preferably, in said method, said preset time period begins to count regardless of whether the bending and bonding after said stage (g) is performed with the pintle in an insertion or position of extraction; and where said bending and bonding by pressure and gluing of each of the parts of the sheet to be formed is carried out in its entirety after placing said sheet in said position of delivery of said stage (c) and after activating the actuators of said stage (1).

With this, it is specified that the present invention is especially useful for machines of the one stage type, and also the preset time period is independent of the type/format of the box to be formed which confers simplicity and efficiency to adjust the machine to the fastest formation speed.

Two types of cardboard box forming machines are differentiated by gluing: those known in the field as one-step machines, where the folding and bonding of each part of the sheet with others is carried out entirely by the action of a pintle and a mold as described; and those known in the field as two-step machines, where the folding and bonding of some parts of the sheet with others is done in two distinct phases, a first phase of folding and bonding some parts of the sheet with others occurs during transport before reaching the pintle area and the mold, and a subsequent second phase of bending and bonding is performed by the action of said pintle and mold. Comparing both technologies, one-step machines produce a greater number of boxes per unit of time, are more compact, economical, and easy to adjust, while two-step machines mount very special box formats (types) that one-step machines do not perform.

Preferably, said method also includes the stage of counting a preset additional time period of programmable duration previously entered in said user interface, starting to count said preset additional time period from the positioning of the drag element in said second position, and where after counting said preset additional time period said stage (f) is executed.

This achieves ab independent parameter, which is used when environmental conditions are unfavorable for necessary glue cooling prior to glue bonding; or it can be reset in case the environmental conditions are favorable for such necessary cooling, so it is only necessary to vary this operational parameter without varying the others to maintain a high production speed.

According to a second aspect, the present invention provides a cardboard box forming machine by gluing from sheets, helping to solve the aforementioned and other inconveniences.

Said box-forming machine comprises: a computer-programmable controller element, a user interface, a supplying actuator of a supplying mechanism, a stacked sheet loader, a drag element, a rotating motor, a mold with a plurality of forming elements, each activatable by means of a respective actuator, arranged around a slot where a pintle is insertable, said pintle, a rotating motor of a pintle drive, and glue injectors, the box-forming machine being configured to execute the method of the first aspect of the invention.

Preferably, said box-forming machine also comprises another drag element, and an auger flexible transmission element, being the box-forming machine configured to execute the method of the first aspect of the invention. Optionally, this auger flexible transmission element is mounted on two pulleys, with the rotary motor coupled to one of them.

In addition, said box-forming machine also comprises a pintle position detector device, and is configured to execute the method of the first aspect of the invention.

According to a first variant, said box-forming machine also comprises a rotational encoder, and is configured to execute the method of the first aspect of the invention.

According to a second alternative variant, said box-forming machine also comprises an engine speed controller, a rotational encoder, a drag element position detector, and is configured to execute the method of the first aspect of the invention.

According to a third alternative variant, said box-forming machine also comprises an engine speed controller, a rotational encoder, and is configured to execute the method of the first aspect of the invention.

The realizations described in the invention with references to the drawings include methods for the formation of cardboard boxes by gluing into a box-forming machine from sheets and said machine for the execution of said method. However, the invention also extends to computer programs for said machine to execute said method, and also with computer programs in or on a readable device, configured to put the invention into practice.

According to a third aspect, the present invention provides a computer program comprising instructions for a corresponding box-forming machine of the second aspect of the invention to execute a corresponding method of the first aspect of the invention, helping to solve the aforementioned and other drawbacks.

Said, computer program, as well as its instructions, may be in the form of source code, object code or in intermediate code between source code and object code, such as in partially compiled form, or in any other appropriate form to use in the implementation of the methods according to the invention.

According to a fourth aspect of the invention, the present invention provides a computer-readable device that has stored a computer program of the third aspect of the invention, helping to solve the aforementioned and other drawbacks.

Preferably, said computer-readable device is a corresponding programmable logic controller with said computer-programmable controller element of the first, second, and third aspects of the invention.

Said computer-readable device can be any entity, unit, element, or device that has the computer program stored, for example, a storage device, such as a memory that is an integral part of a PLC or a user interface such as a touch screen, a ROM, for example, a compact CD ROM disk or a semiconductor ROM, a magnetic recording device, such as a flexible disk or hard drive, or a portable USB device, among others. In addition, the readable device can be a readable device transmissible via electrical cable, optical, wireless signal, radio signal or other electromagnetic signal, among other devices.

When the computer program is contained in a signal that can be transmitted directly via a cable or other device, the readable device may be understood by said cable or other device.

Alternatively, the readable device can be an integrated circuit in which the computer program is encapsulated (embedded), being adapted said integrated circuit to perform, or to be used in the realization of, the relevant methods. The term "encapsulated" is also known in technical literature as absorbed, fitted, or embedded.

Throughout the description and claims the word "includes" and its variants are not intended to exclude other technical characteristics. In addition, the word "includes" includes the case "consists of." For experts in the field, other objects, advantages, and characteristics of the invention will be detached in part from the description and partly from the practice of the invention. Other realizations can be made by experts in the field in the light of this description without going outside the scope defined in the claims. The claims have been expressly drafted to include a method of forming boxes in which the stages are distributed amidst a plurality of computer programmable controller elements, falling within the scope of the present invention.

The following examples and drawings are provided as illustrations, and are not intended to limit the present invention. The letters assigned to each of the stages and placed in parentheses in a claim, are only to try to increase the understanding of the claim and should not be interpreted as limiting the order in which said stages occur. The present invention covers all possible combinations of particular and preferred realizations indicated herein.

In the present invention the term "computer programmable controller element" comprises any controller element in which the program it has stored is programmable and/or readable by a computer. Examples of these are the terms "micro-controller," "controller," "programmable automaton," "control system," "control unit," "programmable logic controller," "processor," "microprocessor," "computer," and "laptop." among others.

The term "connected" includes to connect two elements directly or indirectly via a wireless connection or by means of control signal cables, which may be, for example, communications buses, or multi-link or single-line cables, fiber optic or ethernet cables, for example, "etherCAT®".

The term "user interface" may include a touch screen, pushbuttons, selectors, and any of the "drive organs" defined in the 2006/42/EC machinery directive, among others.

A BRIEF DESCRIPTION OF THE DRAWINGS

To complement the description that is being made of the object of the present invention and to help for a better understanding of the characteristics that distinguish it, it is accompanied in the present descriptive memory, as an integral part of it, a set of plans, in which, for illustrative and not limiting purposes, the following has been represented:

Figure 2:
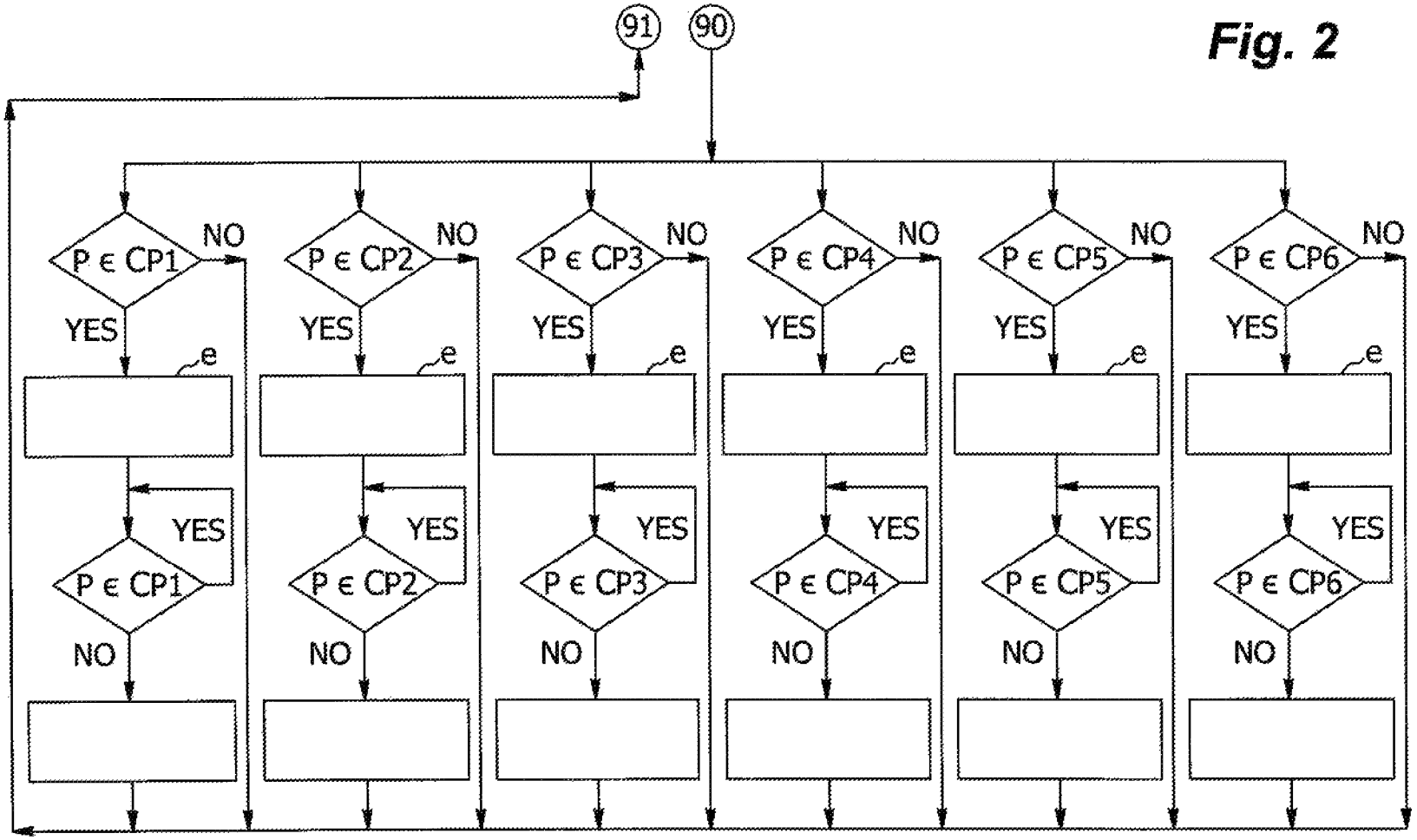
FIG. 2 shows a part of the flowchart in FIG. 1, corresponding to Labels 90 and 91 of FIG. 1.
Figure 3:
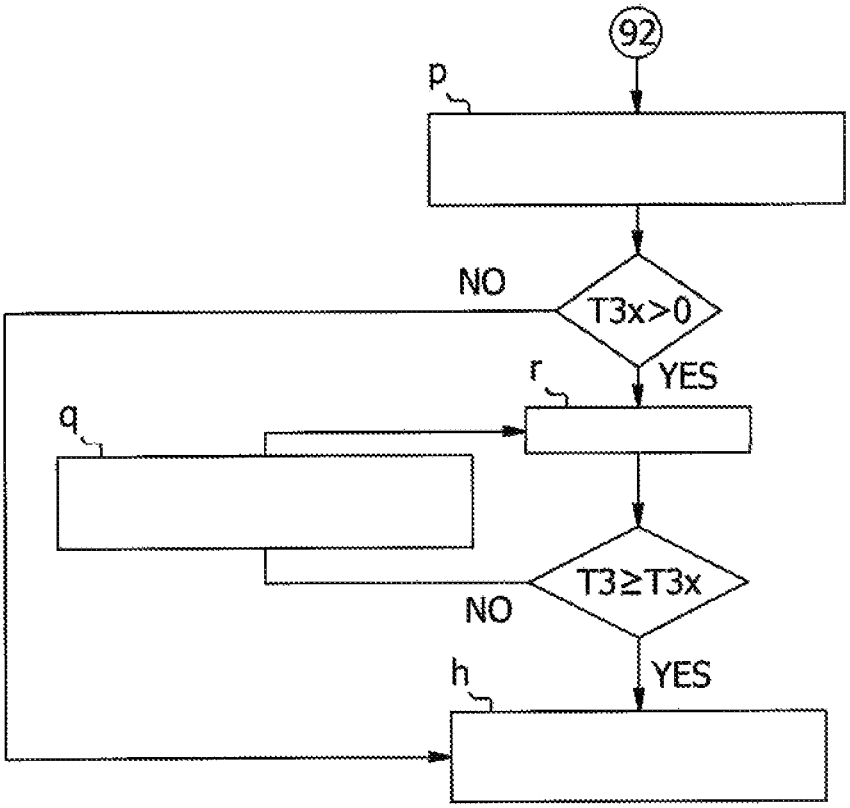
FIG. 3 shows a part of the flowchart in FIG. 1, corresponding to label 92 of FIGS. 1 and 4.
Figure 4:
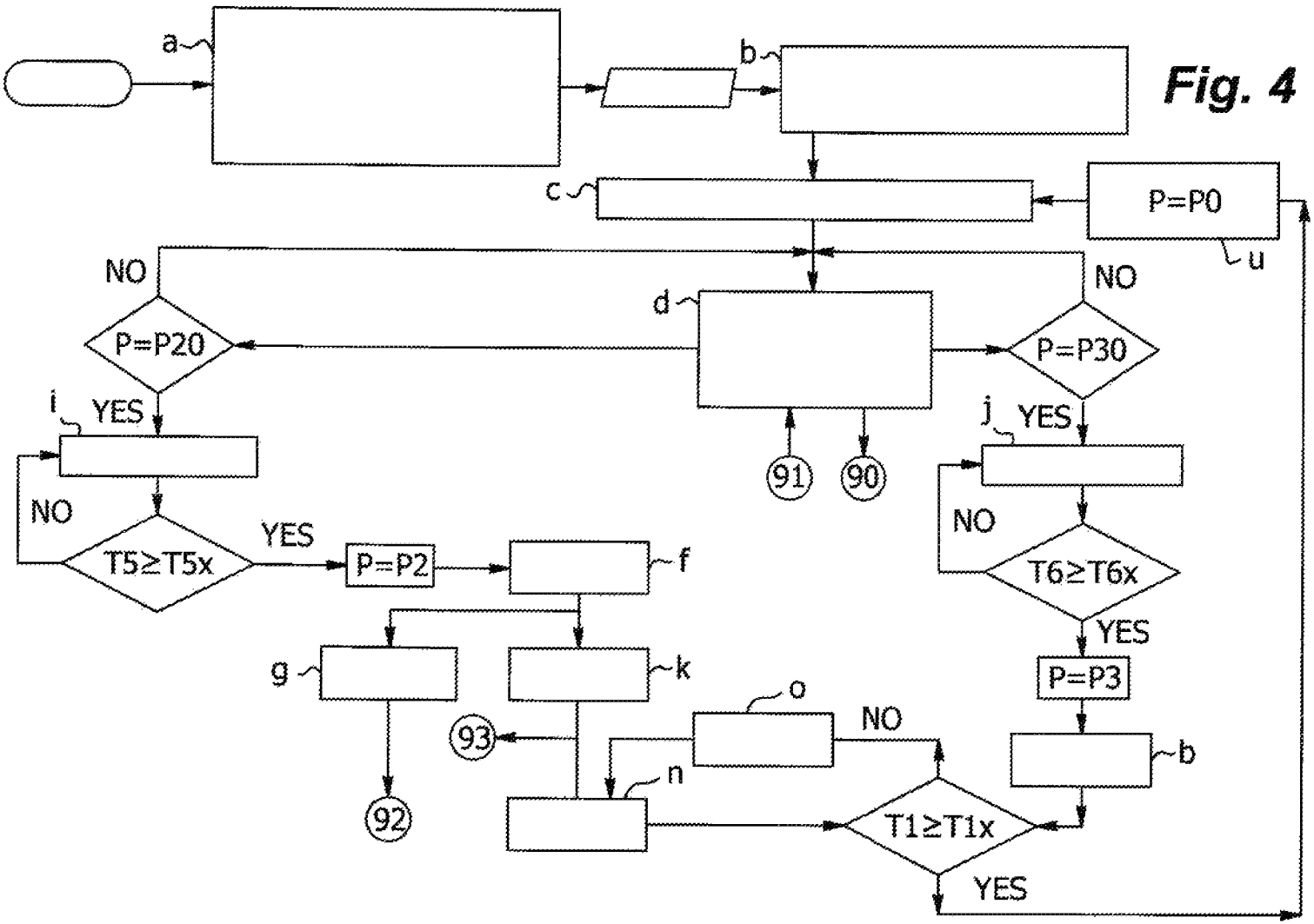
Figure 10:
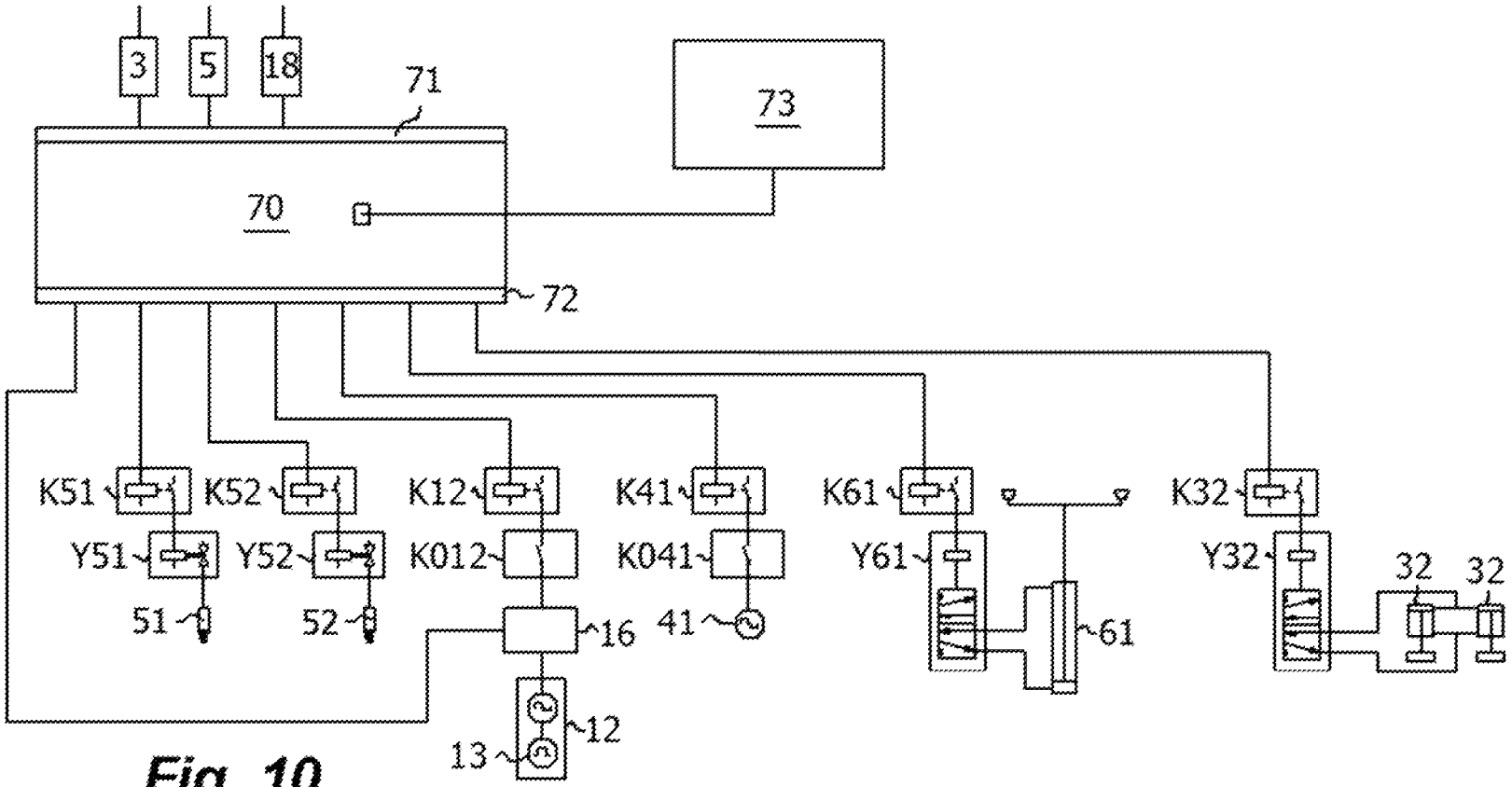
Figure 11:
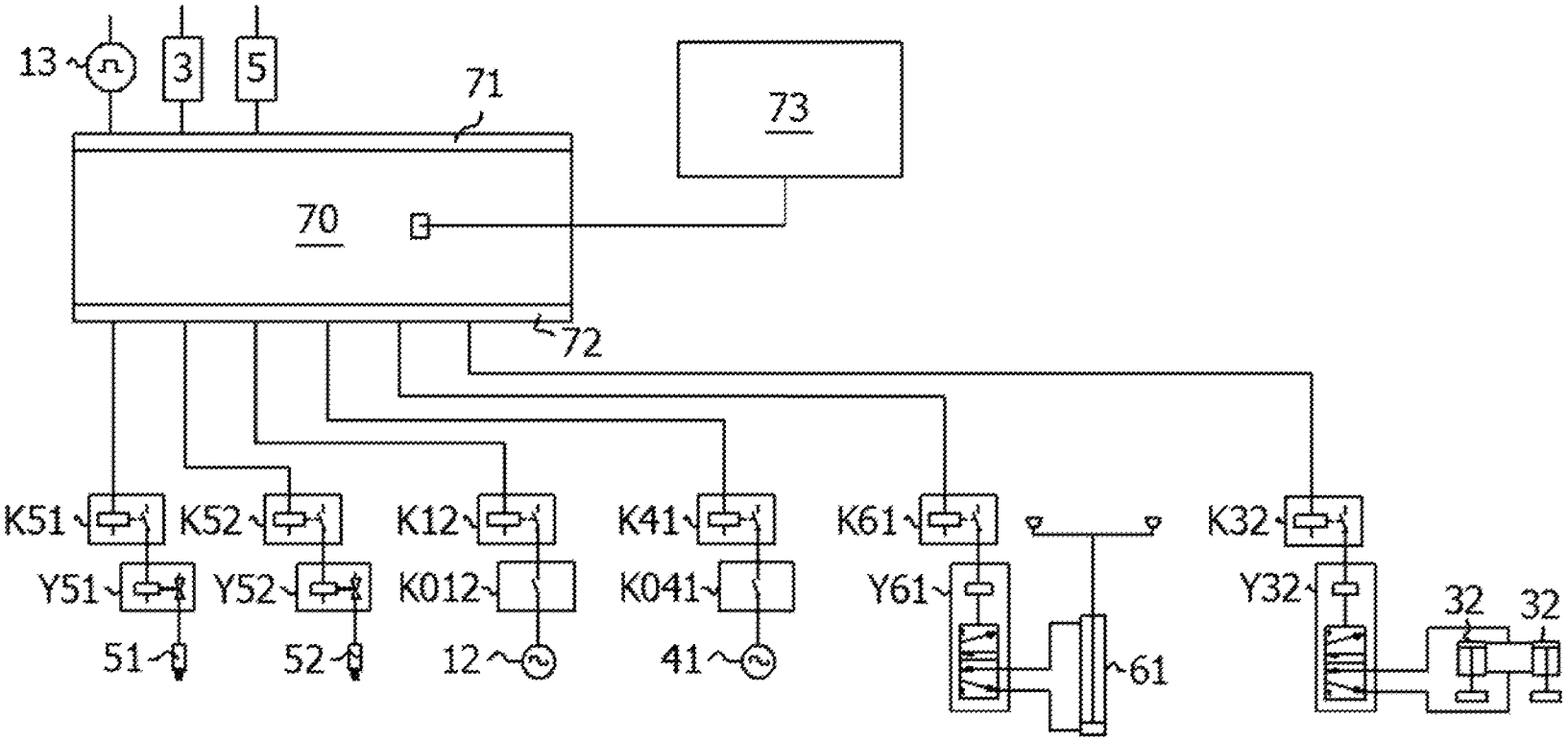
Figure 13:
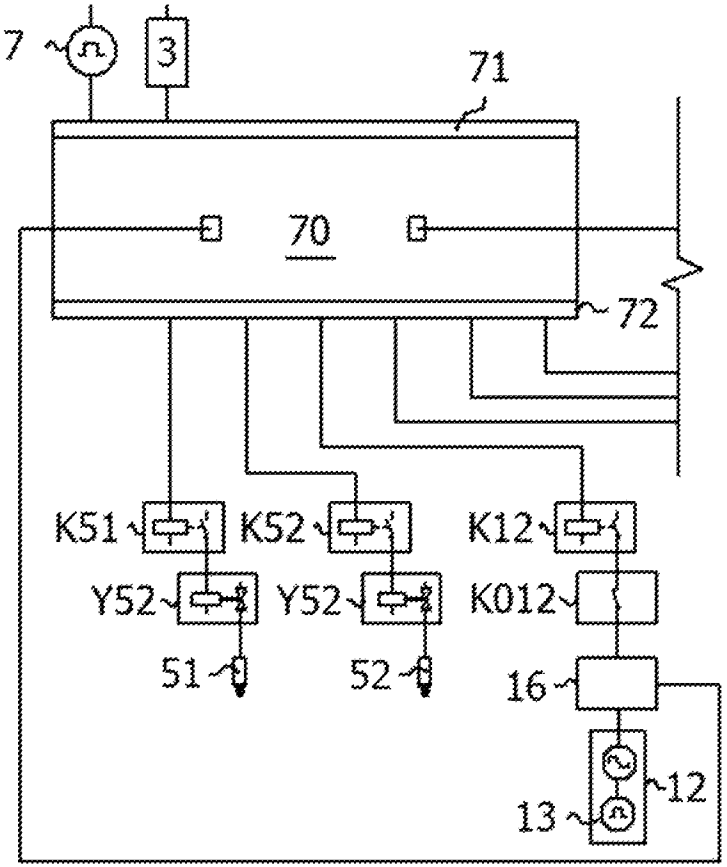
Figure 12:
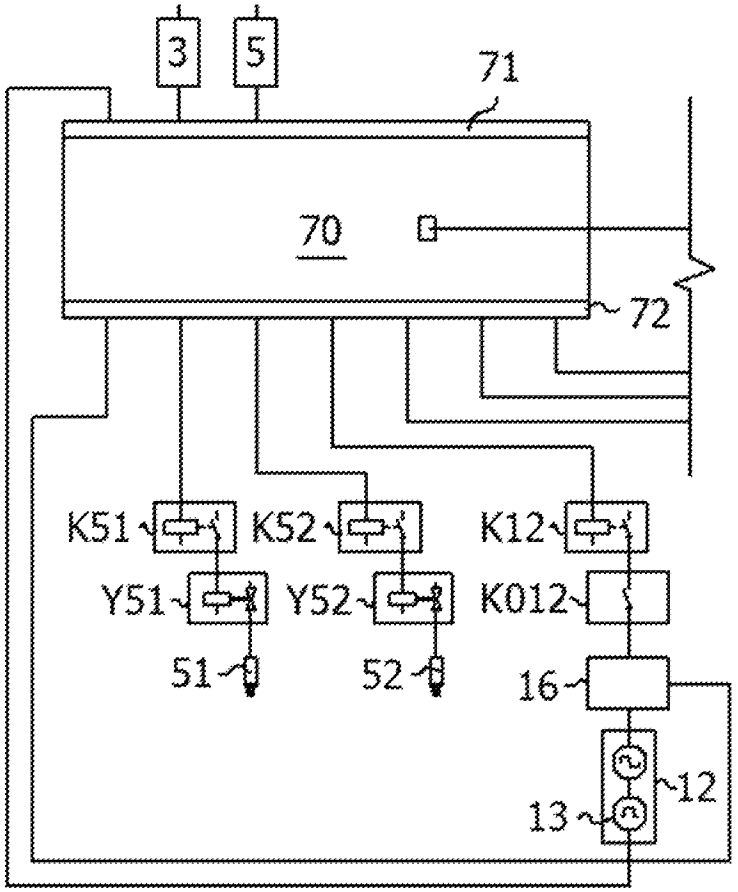

FIG. 4 shows a flowchart of the stages of the method for the formation of boxes by gluing of the present invention, according to a second realization, where labels 90, 91, and 92 indicate that FIGS. 2 and 3 are also an integral part of this second realization;

FIGS. 5 through 9 show a schematic sequence of operation of the box-forming machine of the second aspect of the invention according to a first realization, and in which are executable either of the two methods of FIGS. 1 through 5;

FIGS. 10, and 11 show respective connection schemes of different elements of the machine to the computer-programmable controller element of the box-forming machine of the second aspect of the invention, according to a first and second realizations, respectively, where only two of the six glue injectors are shown;

FIGS. 12 and 13 show respective connection schemes trimmed from different elements of the machine to the computer-programmable controller element of the box-forming machine of the second aspect of the invention, according to respective third and fourth realizations, respectively, and where the other trimmed elements are identical to the elements of FIGS. 10 and 11.

Figure 14:
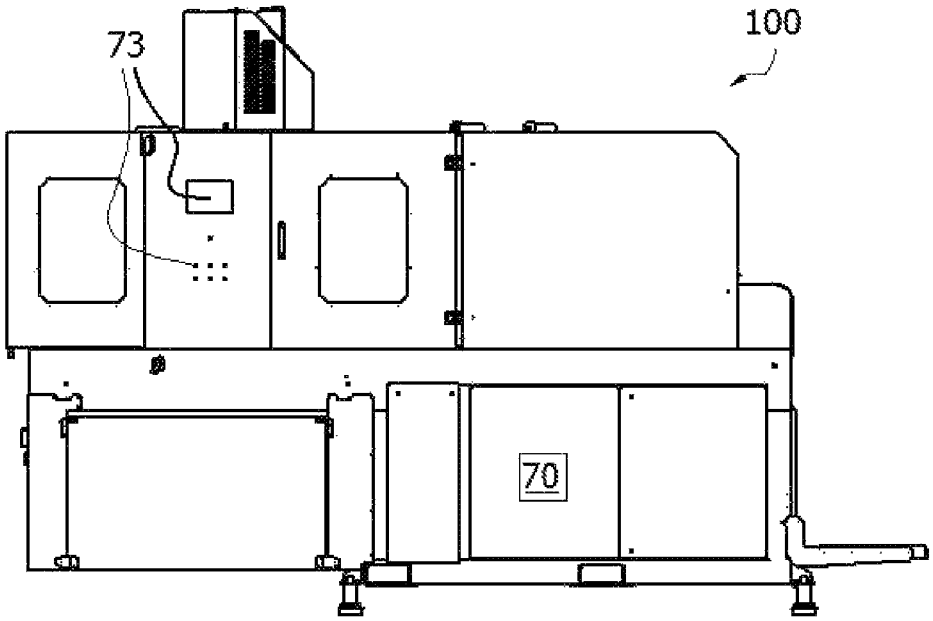
Figure 15:
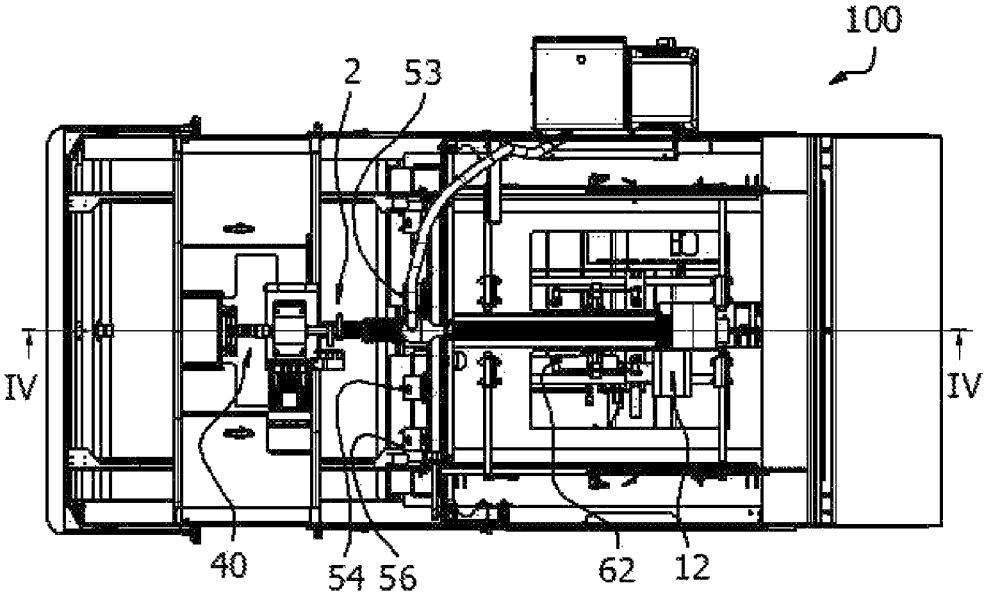
Figure 16:
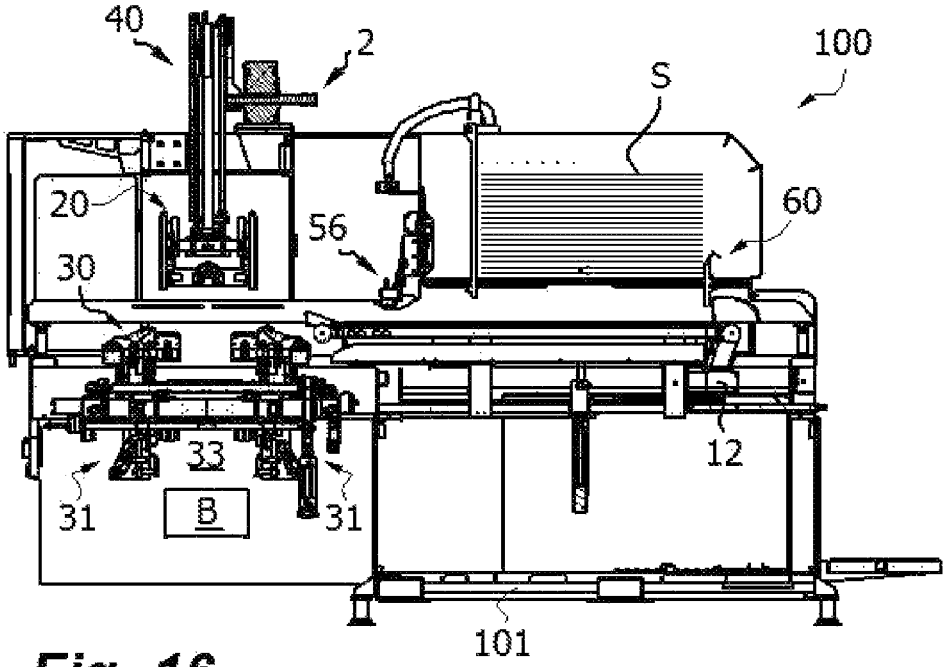
Figure 17:
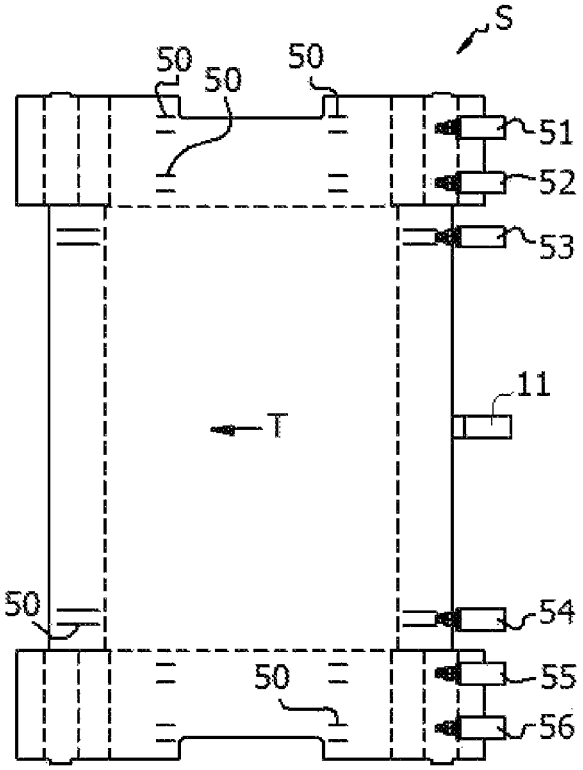
Figure 18:
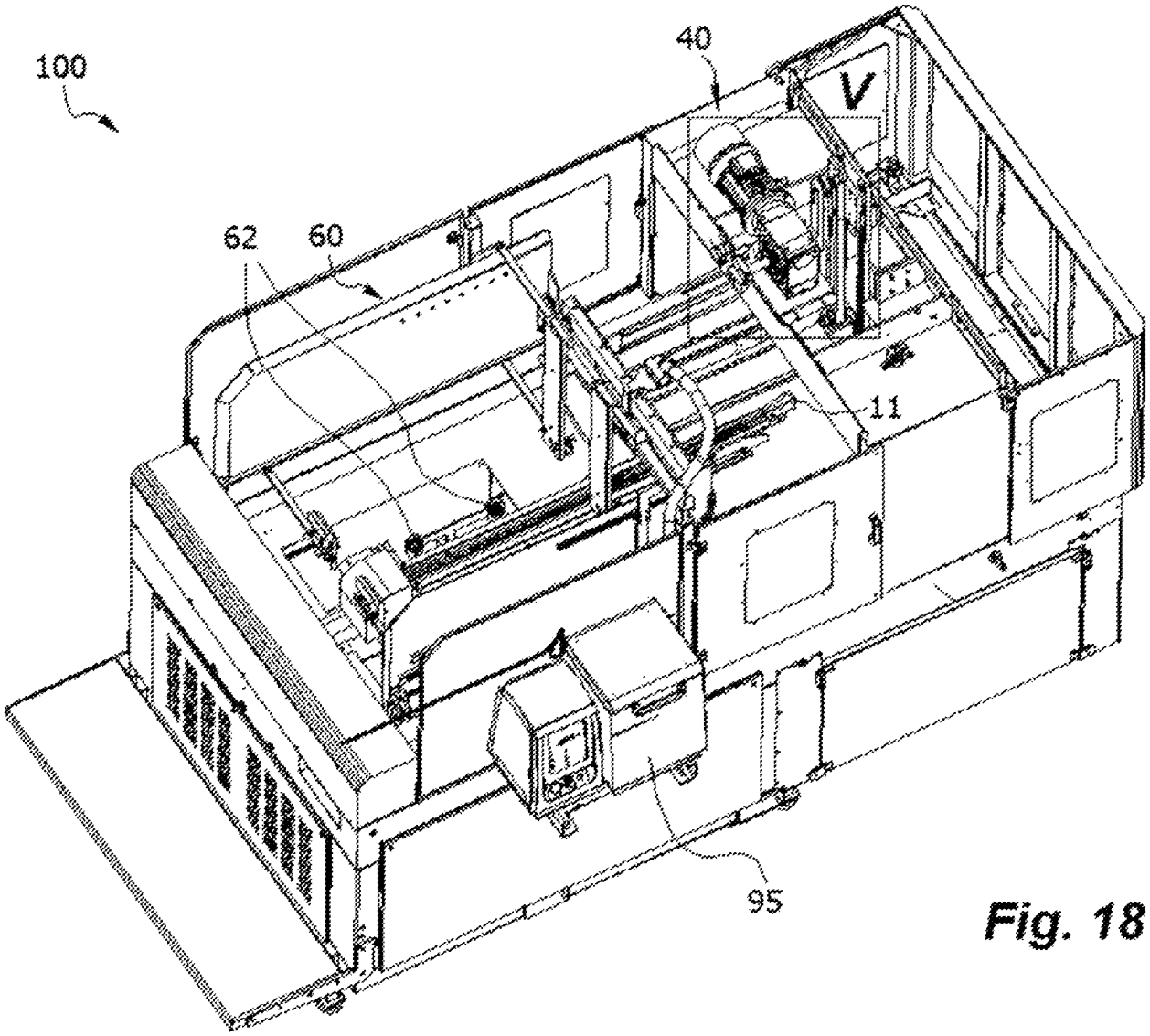
Figure 19:
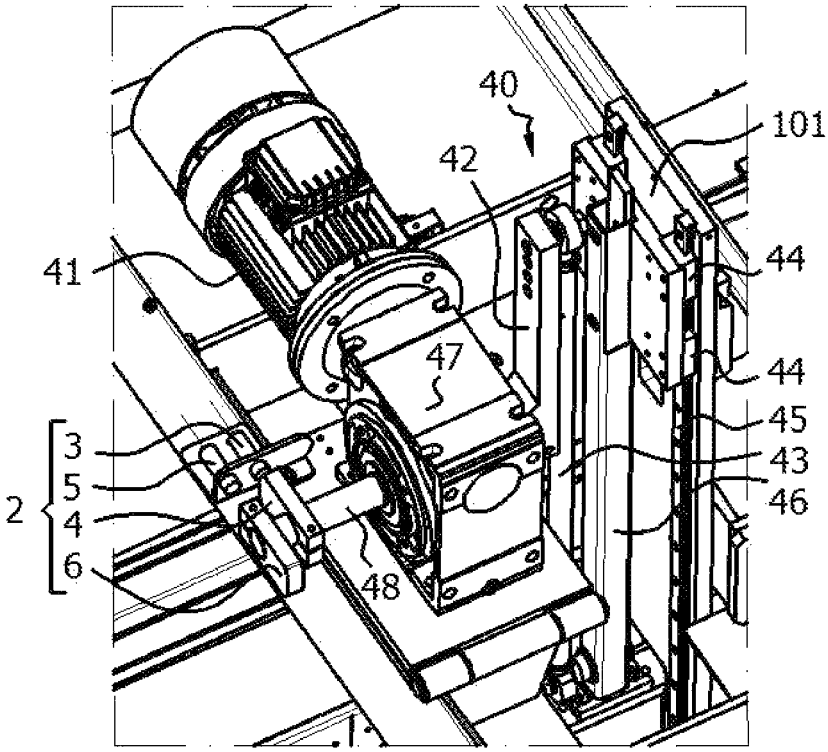

FIG. 14 is a side view a machine forming cardboard boxes by gluing from sheets representative of any realization of the box-forming machine of the second aspect of the invention;

FIG. 15 is a view in the representative floor of any of the first, second, and third realizations of said machine of the present invention, and indicating an IV-IV cut;

FIG. 16 is the section view of the IV-IV cut of FIG. 15:

FIG. 17 shows glue cords applied to a sheet by the respective activations and deactivations of each glue injector, while the sheet is dragged by the drag element;

FIG. 18 represents a rear top perspective view of the machine of the second aspect of the present invention according to any of the first, second, and third realizations, and indicating a detail V:

FIG. 19 is the detail view V of FIG. 18; and

Figure 20:
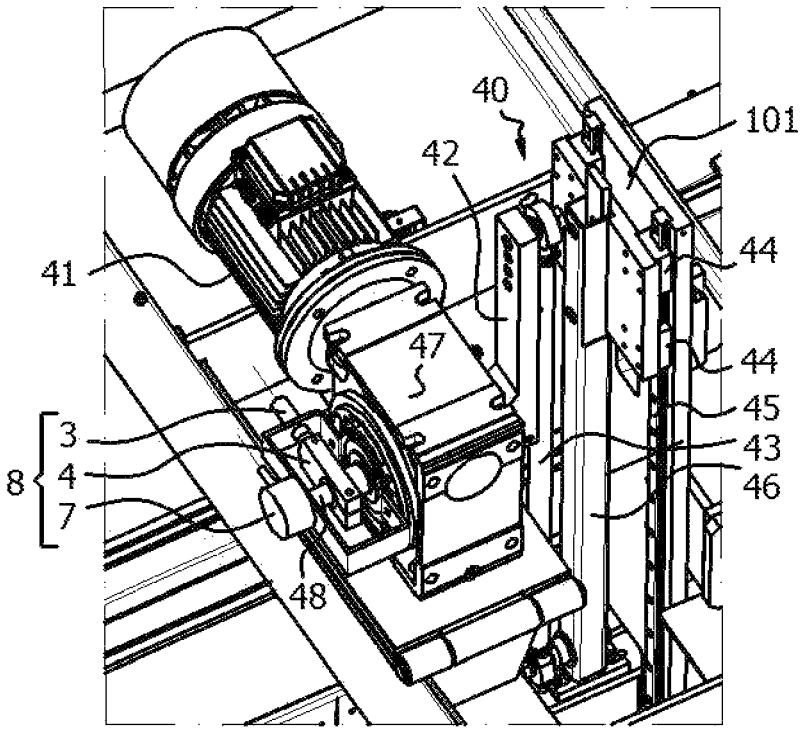

FIG. 20 is the rear top-looking view of said machine of the second aspect of the present invention, according to a fourth realization.

DETAILED EXPOSURE OF MODES OF REALIZATION/EXAMPLES

Figure 1:
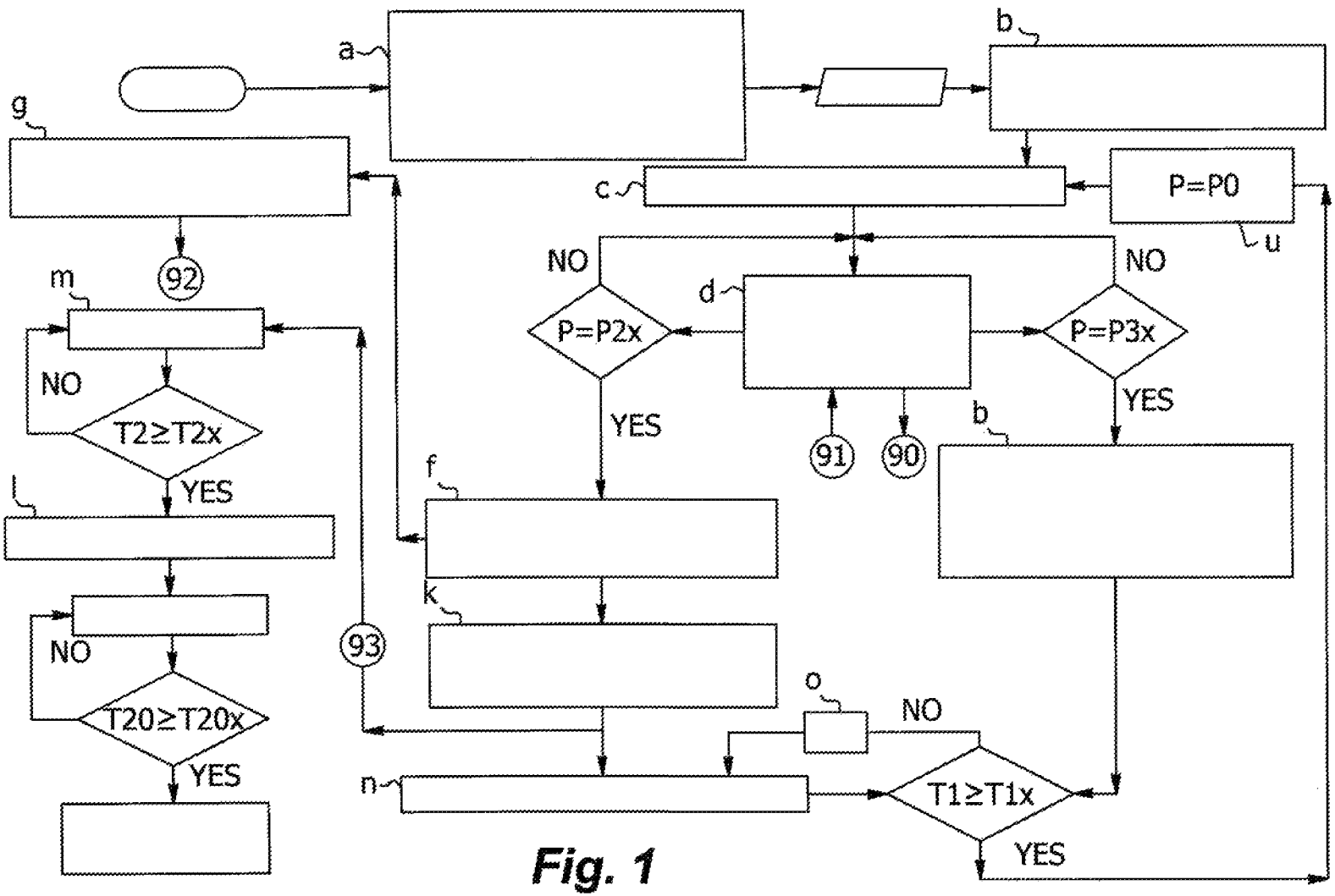
FIG. 1 shows a flowchart of the stages of the method for the formation of boxes by gluing of the first aspect of the present invention, according to a first realization.

FIGS. 1 to 3 show a first realization of a corresponding flowchart with the stages of a method for forming cardboard boxes (B) by gluing into a box-forming machine (100) from sheets (S).

In FIG. 1, this method begins with stage (a) of receiving, in a computer-programmable controller element (70), for example, a programmable logic controller (PLC), operational values (CP1, CP2, CP3, CP4, CP5, CP6, P2, P3, T1*x*, T2*x*, T3*x*, Vx) for a certain type and measurements of a box (B) to form, sent from a user interface (73) such as that shown in FIGS. 10 and 14, materialized in pushbuttons and a touch screen.

The user then interacts with said user interface (73) so that the PLC (70) receives from it an indicative signal for the start of the automatic formation cycle.

Then, in FIG. 1, the method continues with stage (b) of activating a supplying actuator (61) of a supplying mechanism with a plurality of succionators (62), using a controller element (70), sending an indicative signal from said controller element (70) to said supplying actuator (61), to supply a sheet (S) from an initial position where it is supported in a stacked sheet loader (60) to a source position.

In FIG. 1, after the sheet (S) is supplied to said source position, the method continues with stage (c) of moving a drag element (11) to drag said sheet (S). To do this, an indicative signal is sent from said controller element (70) to said rotary motor (12) operationally coupled to said drag element (11).

Said movement of the drag element (11) is along positions according to a linear drag direction (T), associated with respective sheet positions (S), from said source position to a delivery position, where the sheet (S) is located between a pintle (20) and a mold (30), with a plurality of forming elements (31), activated by respective actuators (32), arranged around a slot (33) where said pintle (20) is insertable, as shown in FIGS. 5 to 9.

Looking at FIGS. 1 and 10, at said stage (c) said rotary motor (12) moves the drag element (11), based on a programmable preset desired speed indicator (Vx), introduced by a user in the user interface (73) prior to stage (a) of a plurality of nonzero selectable speeds, sending from said controller element (70) indicative of the type of pulse train signals to a motor speed controller (16) connected to said rotary motor (12). In an option of said FIG. 10, the motor speed controller (16) is a servo motor controller and said rotary motor (12) is a servo motor. Alternatively, the motor speed controller (16) is a frequency inverter, and the rotary motor is a conventional electric rotary motor.

FIGS. 1 and 5 to 9 show that the method involves the stage of rotating in the same direction said rotary motor (12) during stage (c), which is operationally coupled to an auger flexible transmission element (14) where two drag elements (11) are mounted, said drag element (11) and another drag element (11), at mutually opposite ends, by means of a signal sent from a computer-programmable controller element (70) to said rotary motor (12), moving those two drag elements (11) in opposite directions of the linear drag direction (T), alternating between the source and delivery positions, synchronizing the movement of the drag element of said stage (c) with the movement of the other drag element (11) that does not drag a sheet (S) from the delivery position to the source position to drag a subsequent sheet.

This method in FIG. 1 also includes stage (d) continuously reading the position (P) of said drag element (11) associated with the position of said sheet (S) during stage (c), in a computer-programmable controller element (70).

Said stage (d) includes the stage(s) of reading in said controller element (70) such indicative signals sent by said controller element (70) to the rotary motor (12) at said stage (c), and stage (t) to convert, in said controller element (70), the indicative signals read at said stage (s) into positions of a drag element (11). That is, the controller element reads the signal sent by itself based on the programmable preset desired speed indicator (Vx).

FIG. 1 compares in said controller element (70), the position (P) of the drag element (11) read in stage (d) with a third position (P3) intermediate between said source position and said second position (P2). In FIG. 1 said third position (P3) is defined by a corresponding operational value with a third programmable preset position (P3*x*) of the drag element (11), previously received at stage (a). If these positions do not match, it will continue to be read in stage (d). If these positions coincide, stage (b) is started again, activating said supplying actuator (61) using said controller element (70), to supply a subsequent sheet (S) to be formed from said starting position to said source position.

Following in FIG. 2, corresponding to labels 90 and 91 of FIG. 1, said controlling element (70) compares whether or not the position (P) read of the drag element (11) coincides with one or more of the respective preset positions within the respective sets of pre-established activation positions (CP1, CP2, CP3, CP4, CP5, CP6), of each of those glue injectors (51, 52, 53, 54, 55, 56), programmable and previously received in stage (a).

An example of these first preset positions received by the controller from the user interface (73) is: 2460, 2580, 3205, and 3270 for the four glue injectors (51, 52, 55 and 56); and 1950, 2230, 3350, 3670 for the two glue injectors (53, 54).

Said PLC (70) defines respective sets of preset activation positions (CP1, CP2, CP3, CP4, CP5, CP6), of each of these glue injectors (51, 52, 53, 54, 55, 56), which in this example are: CP1=CP2=CP5=CP6=[2460, 2580] U [3205, 3270]; CP3=CP4=[1950, 2230] U [3205, 3270].

FIGS. 2 and 17 show that where the position (P) of said drag element (11) read at stage (d) belongs to one of the respective preset positions within the respective sets of pre-set activation positions (CP1, CP2, CP3, CP4, CP5, CP6), said controller element (70) executes stage (e) of activating the glue injectors (51, 52, 53, 54, 55, 56), to deposit hot-glue cords (50) parallel to each other on said sheet (S) during stage (c). If it does not belong to the set of preset positions, it will continue to be read at stage (d). Following this example, in position P=2000, the glue injectors (53, 54) are activated and the remaining glue injectors (51, 52, 55, 56) are disabled.

In FIG. 2, once a particular glue injector has been activated, it remains activated if said position (P) belongs to the set of preset positions of said glue injector. This particular glue injector is then deactivated when said position (P) does not belong to its set of preset positions. In this example, FIG. 17 can represent the glue injector (51) that is activated between position 2460, is kept activated through position 2580 where it is deactivated, it is re-activated at position 3205 through position 3270, where it is deactivated again, depositing two pairs of glue cords (50) mutually parallel on the sheet (S).

FIG. 10 shows that the activation and deactivation of said glue injectors is performed by sending respective indicative signals from said controller element (70) to each of the glue injectors (51, 52, 53, 54, 55, 56), more specifically, to their respective solenoid valves (Y51, Y52) that open or close the glue passage in each glue injector (51, 52).

Returning to FIG. 1, the method comprises stage (f) moving said pintle (20) according to a linear sense of insertion, from a position of extraction, to allow the sheet (S) to be positioned in the delivery position, and to an insertion position, where said pintle (20) is inserted into said slot (33), sending an indicative signal from a computer-programmable controller element (70) to a rotary motor (41) of a pintle drive (40) configured to steer said pintle (20).

Figure 8:
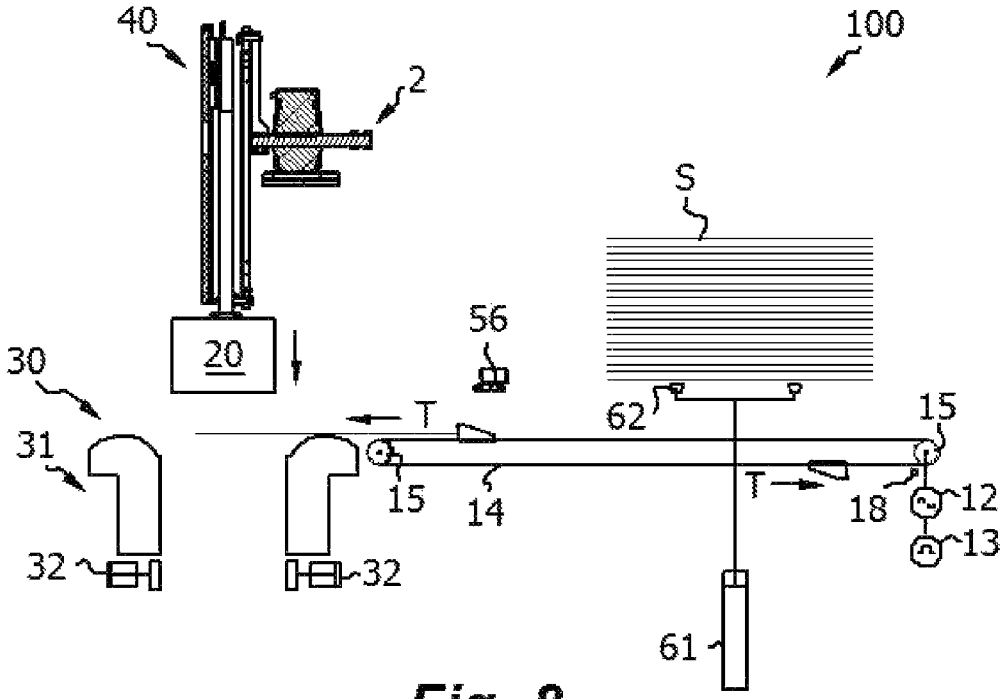

FIGS. 1 and 8 show that stage (f) of moving said pintle (20) according to a linear sense of insertion, it is initiated by said controller element (70) when the position (P) of said drag element (11) read at stage (d) corresponds to a second position (P2) intermediate between said source and delivery positions, with said second position (P2) being defined by a corresponding operational value with a second preset position (P2*x*) of the drag element (11) programmable, previously entered by a user in a user interface (73) and received at stage (a). In this example, until said position (P) is not equal to said second position (P2), it is still read in stage (d).

Figure 9:
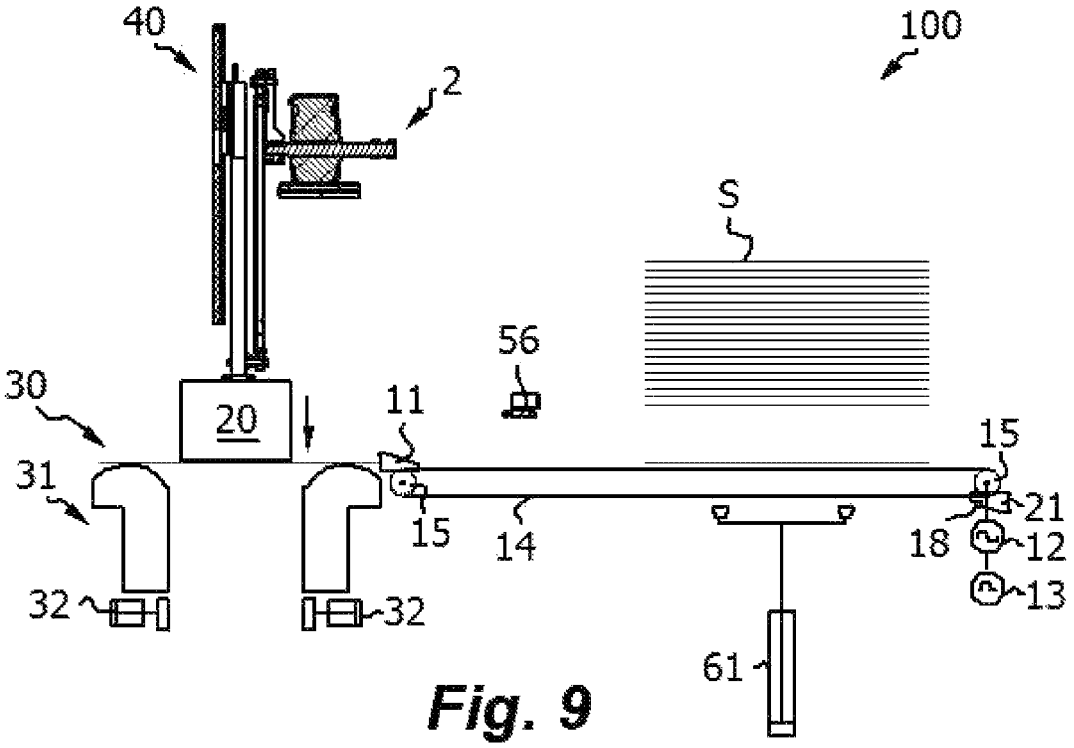

FIGS. 1, 8, and 9 show said stage (f) of moving said pintle (20) according to a linear sense of insertion, from a position of extraction, to allow the sheet (S) to be positioned in the delivery position, and to an inserted position, where said pintle (20) is inserted into said slot (33), sending an indicative signal from a computer-programmable controller element (70) to a rotary motor (41) of a pintle drive (40) configured to steer said pintle (20).

When initiating said stage (f) of FIGS. 1 and 8, stage (k) is produced of detecting a change in the position of the pintle (20) from a position of extraction, receiving in said PLC (70) an indicative signal sent by a pintle position detector device (2) materialized in an inductive detector (3) shown in detail in FIG. 20. Alternatively, this signal is sent from a pintle detector device (8) it is materialized in a pintle rotational encoder (7) shown in FIGS. 14 and 21, and which also includes said inductive detector (3).

Alternatively to this first method of realization, said stage (k) is executed by sending from said PLC (70) its own signal generated in said PLC (70) and subsequently sent by said PLC (70) to said rotary motor (41) moving the pintle (20) according to said direction of insertion of said stage (f).

FIG. 1 shows that with the detection of said stage (k), the computer-programmable controller element (70) initiates two stages simultaneously, stage (n) of counting a time period (T1), and stage (m) of counting a secondary time period (T2).

Following in FIG. 1, where the secondary time period (T2) is equal to or greater than the preset secondary time period (T2*x*) of programmable duration previously received at stage (a), the PLC (70) performs stage (1) of activating said actuators (32) of said forming elements (31), sending an indicative signal from said PLC (70) to said actuators (32), materialized in pneumatic cylinders shown in FIG. 10. If said secondary time period (T2) is not equal to or greater than said preset secondary time period (T2*x*), the secondary time period (T2) is still in stage (m).

Once said actuators (32) have been activated, said PLC (70) starts the stage of having an additional time period (T20) and keeps the actuators (32) active for an additional preset time period (T20*x*) of programmable duration previously received at said stage (a). When the supplemental time period (T20) is equal to or greater than said supplemental preset time period (T20*x*), the actuators are disabled.

In FIG. 1, parallel with stages (n) and (m) of counting said time period and secondary time period (T1, T2), said stage (f) of movement of the pintle according to the sense of continuous insertion continues, and stage (g) is produced by pressing of said pintle (20) a part of said sheet (S) arranged between said slot (33) and pintle (20) in the position of delivery to the interior of the slot (33). FIG. 10 represents said stage (g).

FIGS. 1, 3, 5 to 10, and 14 to 19 show that in the method of this first realization, said preset time period (T1*x*) begins to count regardless of whether the bending and bonding after said stage (g) is performed with the pintle (20) in a position of insertion or extraction; and where such formation by bending and bonding by pressure and gluing of each of the parts of the sheet to be formed is carried out in its entirety after placing said sheet (S) in said position of delivery of said stage (c) and after activating the actuators (32) of said stage (1).

Figure 5:
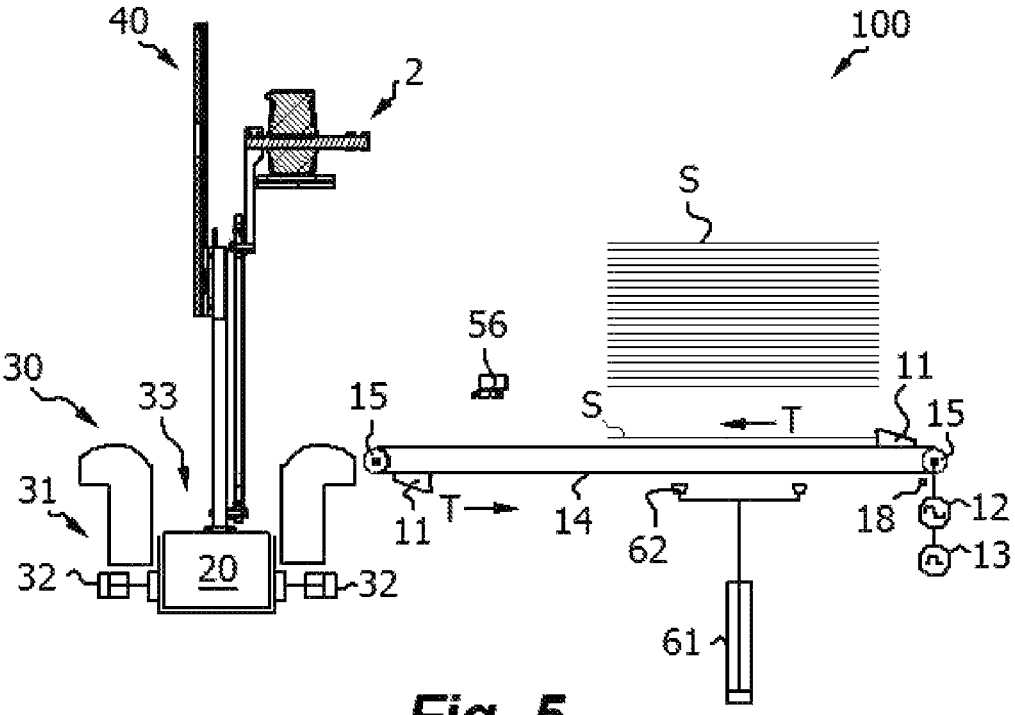

FIGS. 1 and 5 show that in the interior of said slot (33), each of the two actuators (32) moves a respective forming element (31) of the mold (30), in cooperation with other parts of the mold (30) and the pintle (20), pressing some parts of said sheet against others to form the box, by bending and bonding by gluing and pressure.

After said stage (g), and with the pintle (20) moving in the direction of insertion, in label 92 of FIGS. 1 and 3 shows that the method continues with stage (p) of detecting said pintle (20) in said position of insertion when receiving in said PLC (70) an indicative signal sent by said pintle position detector device (2), materialized in another inductive detector (5) shown in FIGS. 10 and 20. Alternatively to this first realization, this indicative signal is sent by a pintle detector device (8) materialized in a second rotational pintle encoder (7) shown in FIGS. 13 and 20.

In another alternative to this first method of realization, said stage (p) is executed by receiving/reading in said PLC (70) the indicative signal previously generated in said PLC (70) sent by said PLC (70) to said rotary motor (41) to move the pintle (20) according to said direction of insertion of said stage (f).

When the value of the preset auxiliary time period (T3*x*) is greater than zero, said PLC (70) continues with stage (r) of having a third time period (T3), which is compared to a preset auxiliary time period (T3*x*) of programmable duration, previously received at said stage (a), starting to count said preset auxiliary time period (T3*x*) after said stage (p).

Until said auxiliary time period (T3) does not equal or exceed said preset auxiliary time period (T3$x$), said PLC (70) continues to count said auxiliary time period (T3) and keeps said pintle (20) in said position of insertion, depending on stage (q) of FIG. 3.

When the auxiliary time period (T3) is equal to or greater than said third preset time period (T3$x$), the PLC (70) initiates stage (h) of moving said pintle (20) according to the direction of extraction.

Figure 6:
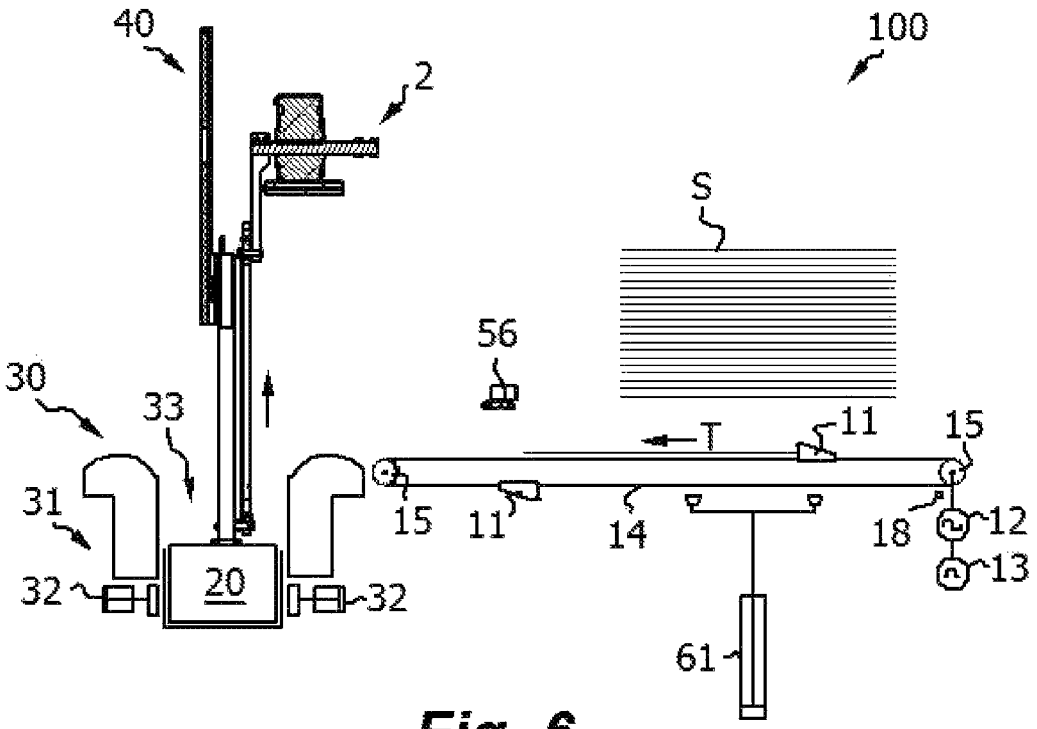
Figure 7:
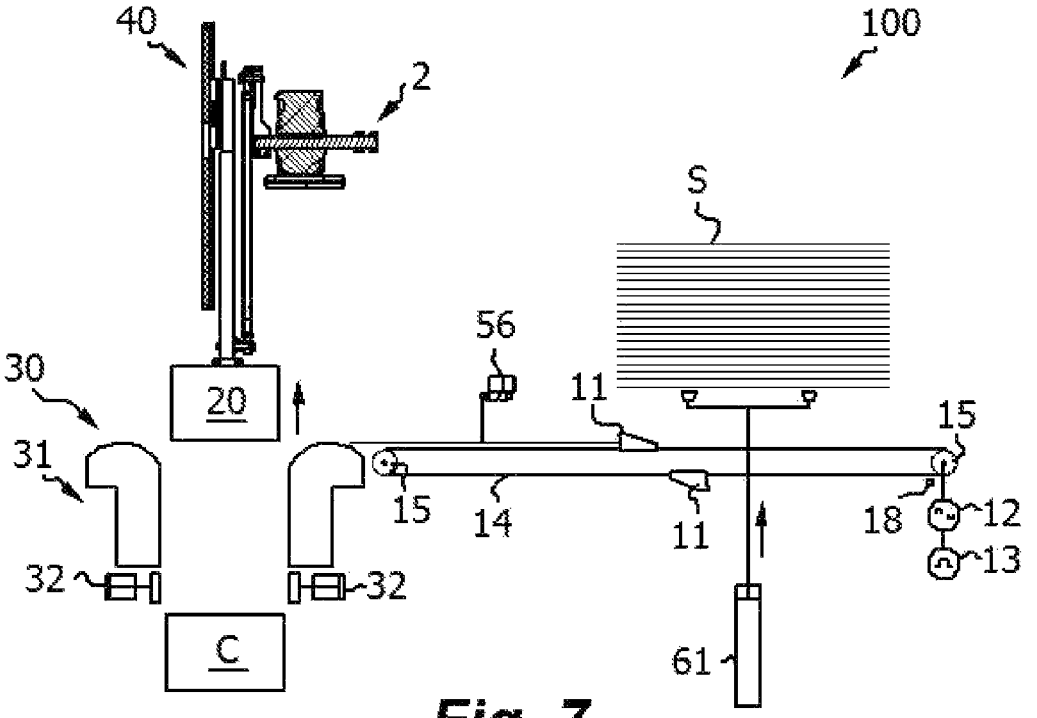

FIGS. 1, 6, and 7 show that said PLC (70) moves said pintle (20), according to a direction of extraction opposite said direction of insertion, from said position of insertion to said position of extraction, sending an indicative signal from a computer-programmable controller element (70) to a rotary motor (41) of a pintle drive (40) configured to steer said pintle (20).

At this point, at a stage not shown to give clarity of the diagrams, the pintle is detected in a position of extraction similarly to any of the possibilities described for stage (k). A specific example of detection is performed by a detector (5) that reads the position of the cam (5) in FIG. 19 and sends a signal to the PLC (70). With the pintle (20) in a position of extraction, it is ready for a subsequent formation cycle.

Following FIG. 1, where the first time period (T1) counted on said PLC (70) is less than said preset time period (T1$x$) of programmable duration previously received in stage (a), said PLC (70) holds one of those drag elements (11) standing in said delivery position according to stage (o).

When the first time period (T1) counted on said PLC (70) is greater than or equal to said preset time period (T1$x$), said stage (c) starts again, to drag a subsequent sheet (S) to said previous sheet (S), after stage (u) of setting the position of the drag element (11) to a source value (P0) after each detection, in a drag element position detector (18), of a drag element (11) at said source position.

Also, before re-starting stage (c) to drag a subsequent sheet (S), said PLC (70) sets the time period (T1), the secondary time period (T2), the auxiliary time period (T3), and the additional time period (P20) to respective initial values for the subsequent automatic forming cycle of boxes per gluing.

According to a second realization of this method, shown in FIGS. 2 to 4, it comprises all the stages described for the first realization except for the variations described below.

FIGS. 2 to 4 show a first difference in said method, according to which said second position (P2) is defined by a corresponding operational value with a preset complementary time period (T5$x$).

Said stage (f) starts when the position of the drag element (11) corresponds to said second position (P2), after stage (i) of having in a computer-programmable controller element (70) said preset complementary time period (T5$x$) of programmable duration, starting to count said preset complementary time period (T5$x$) after detecting, in a computer-programmable controller element (70), a position of the drag element (11) dragging the sheet (S) or a position at the front or rear of said sheet in a second previous position (P20), intermediate between said source position and said second position (P2).

In FIG. 4, such detection of the positioning of the drag element (01) prior to the start of stage (i) of counting the complementary time period (T5) is performed by reading in the PLC (70) the type of pulse train signal sent by the PLC itself (70) to the rotary motor (12) to move the drag element of stage (c). If said signal is not equal to said second previous position (P20), intermediate between said source position and said second position (P2), it continues to be read. If said signal does not match said second previous position (P20), intermediate between said source position and said second position (P2), the controller element (70) begins to count a complementary time (T5). When such complementary time (T5) equals to or exceeds said preset complementary time (T5$x$) of programmable duration previously received at stage (a), the PLC (70) initiates said stage (f). At this point the position of the drag element (11) corresponds to said second position (P2).

Alternatively to the method in FIG. 4, such detection of a position at the front or rear of the sheet in a second previous position (P20), intermediate between said source position and said second position (P2) can be performed by a photocell (not shown) located in said second previous position (P20). This PLC (70) receives the signal from said photocell continuously during stage (c). When this photocell detects any of these parts of the sheet (S), it sends a signal to the PLC (70) that begins to count a complementary time (T5). When such complementary time (T5) equals to or exceeds the preset complementary time (T5$x$) of programmable duration previously received at stage (a), said PLC (70) initiates said stage (f). At this point the position of the drag element corresponds to said second position (P2).

Following in the second realization of this method, FIGS. 2 to 4 shows a second difference from said method, according to which said third position (P3) is defined by a corresponding operational value with a preset auxiliary time period (T6$x$). In FIGS. 2 to 4, said stage (b) starts again when the position of the drag element (11) corresponds to said third position (P3), after stage (j) of having in a computer-programmable controller element (70) said preset auxiliary complementary time period (T6$x$) of programmable duration previously received at stage (a), starting to count said preset auxiliary complementary time period (T6$x$) after detecting, in a computer-programmable controller element (70), a position of the drag element (11) dragging the sheet (S) or a position at the front or rear of said sheet in a third previous position (P30), intermediate between said source position and said third position (P3).

In FIG. 4, such detection of the positioning of the drag element (11) prior to the start of stage (j) of counting the auxiliary complementary time period (T6) is performed by reading on said PLC (70) the type of pulse train signal sent by the PLC itself (70) to the rotary motor (12) to move the drag element of stage (c). If said signal is not equal to said third previous position (P30), intermediate between said source position and said third position (P3), it continues to be read. If said signal equals said third previous position (P30), intermediate between said source position and said third position (P3), said PLC (70) begins to count an auxiliary complementary time (T6). When such auxiliary complementary time (T6) equals to or exceeds the preset auxiliary complementary time (T6$x$) of programmable duration previously received at stage (a), said PLC (70) starts said stage (b) again. At this point the position of the drag element (11) read at stage (d) corresponds to said third position (P3).

Alternatively to the method in FIG. 4, said detection of a position at the front or rear of the sheet in a third previous position (P30), intermediate between said source position and said third position (P3), can be carried out by auxiliary photocell (not shown) located in said third previous position (P30). Said PLC (70) continuously receives the signal of the photocells during stage (c). When such an auxiliary photocell detects any of these parts of the sheet (S), it sends a signal to said PLC (70) which begins to count an auxiliary complementary time (T6). When such auxiliary complementary time (T6) equals to or exceeds the preset auxiliary complementary time (T6*x*) of programmable duration previously received at stage (a), said PLC (70) starts said stage (b) again. At this point the position of the drag element (11) read at stage (d) corresponds to said third position (P3).

Continuing in the second realization of this method, FIGS. 2 to 4 show a third difference from said method, according to which in said stage (c) both drag elements (11) are moved according to a fixed nominal velocity, sending a binary signal from the controller element (11) to said rotary motor (12) materialized in a conventional electric rotary motor, coupled to a rotational encoder (13) on its output axis to read the angle rotated by it. In addition, said stage (d) comprises the stage of receiving in said PLC (70) signals indicating the position of a drag element (11) sent by said rotational encoder (13) which reads the angle rotated by the rotating motor (12).

It is noted that the method in FIG. 4 continues on labels 92 and 93, shown in FIGS. 1 and 3, similar to the first realization of the method.

According to a second aspect of the present invention, FIGS. 5 to 10, 14 to 19 show a first realization of a box-forming machine (100) of cardboard by gluing from sheets (S), comprising a series of elements supported in a chassis (101). Said elements are: a controller element (70) computer-programmable materialized in a PLC coupled to a user interface (73) comprising a touch screen and a series of pushbuttons and drive organs distributed in different positions of said machine, a supplying actuator (61) of a supplying mechanism with a plurality of suctions (62), a loader (60) of stacked sheets, a drag element (11), drag element position detector (18), a rotary motor (12) materialized in a servo motor, an encoder (13) connected to said servo motor (12), a mold (30) with a plurality of forming elements (31), each activatable by means of a repetitive actuator (32), arranged around a slot (33) where a pintle (20) is insertable, said pintle (20), a rotary motor (41) of a pintle drive (40), glue injectors (51, 52, 53, 54, 55, 56) powered by a glue equipment (95) equipped with a glue drive pump, and the box-forming machine (100) is configured to execute the method of the first realization of the first aspect of the invention.

In FIG. 10, said PLC (70) is equipped with inputs (71) where two inductive detectors (3, 5) are connected that detect the pintle (20) in a position of extraction and insertion, respectively, as well as said drag element position detector (18). A touch screen (73) is also connected to a PLC input interface (70).

In FIG. 19 is shown that said chassis (101) is supported a pintle position detector device (2) that integrates such inductive detectors (3, 5), each coupled to respective cams (4, 6) coaxially coupled to the rotary shaft (48) of a reducer (47), operationally coupled in turn to the rotary motor (41) of the pintle drive (40), to detect the pintle (20) in a position of insertion and extraction.

In FIG. 19, said pintle drive (40) also comprises a crank (42) attached jointly to said rotary shaft (48), and a crank (43) articulated at its proximal end to said crank (42) and articulated at its distal end to an arm (46). Said arm (46) is guided vertically by two vertical guides (45) supported in said chassis (101) and each attached to a pair of conjugated guides (44) jointly attached with said arm (46). At one end of said arm (46) is supported said pintle (20).

FIG. 10 shows said PLC (70) equipped with outputs (72) where are connected some relays (K51, K52) that open and close each of them a respective contact that energizes a respective coil of a respective solenoid valve (Y51, Y52) that allows or prevents the injection of glue into the glue injectors (51, 52).

FIG. 10 shows said PLC (70) equipped with other outputs (72) where are connected other relays (K61, K32) that open and close each of them a respective contact that energizes a respective coil of a respective solenoid valve (Y61, Y32) that allows or prevents air from passing on one side or the other of the plunger of some respective pneumatic cylinders, corresponding to the supplying actuator (61) and the actuators (32) of the forming elements (31).

FIG. 10 shows said PLC (70) equipped with another output (72) where another optional relay (K41) is connected, and this relay is connected to a contactor (K041) that opens or closes its contacts to supply power to the rotary motor (41) of the pintle drive.

FIG. 10 shows said PLC (70) equipped with another output (72) where another optional relay (K12) is connected, and this relay is connected to a contactor (K012) that opens or closes its contacts to supply power to the servo motor controller (16), which is connected to the rotary motor (12) materialized in a servo motor connected to a rotary encoder (13). In FIG. 12 another output is connected to the servo motor controller (16) to send the pulse train signal.

Returning to FIGS. 5 to 9, said box-forming machine (100) also comprises another drag element (11), an auger flexible transmission element (14). Said auger flexible transmission element (14) is a chain of links and is mounted on two pulleys (15), with the servo motor attached to a reducer (not shown) and the reducer attached to one of those pulleys (15).

FIGS. 11 and 14 show a second realization of the box-forming machine (100), where all the elements are identical to the first realization except that:

- the rotary motor (12) that moves the drag elements (11) is a conventional electric rotary motor, connected to a contactor (K041) that opens or closes its contacts depending on the opening or closing of the contacts of a relay (K041) connected to an output (72) of the PLC (70); and
- in the PLC inputs are connected the rotary encoder (13) and coupled to the rotary motor (12), and such inductives (3, 5) of the pintle position detector device (2).

FIGS. 12 and 14 show a third realization of the box-forming machine (100), where all the elements are identical to the first realization except that:

- the rotational encoder (13) is connected to an input (71) of the PLC (70); and
- the PLC (70) corrects the positions of the drag elements (11) by comparing the signal sent to the servo motor controller (16) with the signal received from said rotational encoder (13) connected to an input (71) of the PLC (70).

FIGS. 13, 14, and 20 show a fourth realization of the box-forming machine (100), where all the elements are identical to the first realization except that:

- the pintle position detector device is a pintle rotational encoder (7) connected to the PLC inputs (70), and optionally also comprises said inductive detector (3);
- the servo motor controller (16) is connected to a PLC input interface (70), for example, with an ethernet cable, so said signals are sent and received between the two elements; and
- the rotational encoder (13) is connected to said servo motor controller (16) by a cable to send signals indicating the position of those drag elements (11), and to correct the position of those drag elements (11).

According to a third aspect of the present invention, a first realization of the computer program comprises instructions for said forming machine described in the first realization of the second aspect of the invention to execute the stages of the method described in the first realization of the first aspect of the invention, said stages being illustrated by FIGS. 1 to 3, showing a flowchart of said computer program.

According to a second realization of the computer program, said computer program comprises instructions for the second realization of said forming machine of the second aspect of the invention to execute the stages of the method described in the second realization of the first aspect of the invention, said stages being illustrated by FIGS. 2 to 4, which shows a flowchart of said computer program.

According to a fourth aspect of the invention, the present invention provides a computer-readable device said has stored a computer program of the third aspect of the invention.

According to the first implementation of said fourth aspect, said computer-readable device is said PLC. That is, the PLC (70) shown in FIGS. 10 and 14 has stored a computer program that, when executed on the machine of the first realization of the second aspect of the invention, executes the stages of the first realization of the method shown in FIGS. 1 to 3.

According to a second realization of this fourth aspect, said computer-readable device is a portable device such as a USB, a CD ROM, or similar, which has stored a computer program that, when executed on the machine of FIGS. 5 to 10 and 14 of the first realization of the second aspect of the invention, executes the stages of the first realization of the shown method in FIGS. 1 to 3.

The invention claimed is:

1. A method for forming cardboard boxes (B) by gluing in a box-forming machine (100) from sheets (S), comprising the steps of:

(a) receiving, in a computer-programmable controller element (70), input values (CP1, CP2, CP3, CP4, CPS, CP6) for a given type and measurements of a box (B) to be formed sent from a user interface (73);

(b) activating a supplying actuator (61) of a supplying mechanism, by the computer-programmable controller element (70), by sending an indicative signal from the computer-programmable controller element (70) to the supplying actuator (61), to supply a sheet (S) from an initial position where it is supported in a stacked sheet loader (60) to a source position;

(c) moving a drag element (11) to drag the sheet (S), sending an indicative signal from the computer-programmable controller element (70) to a rotary motor (12) connected to the drag element (11), in a linear direction (T), associated with respective sheet positions (S), from the source position to a delivery position, wherein the sheet (S) is placed between a pintle (20) and a mold (30), with a plurality of forming elements (31), each activated by a respective actuator (32), arranged around a slot (33) wherein the pintle (20) is insertable;

(d) reading the position of the drag element (11) associated with the position of the sheet (S) continuously moving the drag element, in the computer-programmable controller element (70);

(e) activating glue injectors (51, 52, 53, 54, 55, 56), to deposit hot-glue cords (50) parallel to each other on the sheet (S) while moving the drag element, sending respective indicative signals from the computer-programmable controller element (70) to each of the glue injectors (51, 52, 53, 54, 55, 56), when the position of said drag element (11) read continuously coincides with one or more respective pre-established first positions included in the respective sets of pre-established activation positions (CP1, CP2, CP3, CP4, CPS, CP6), of each of the glue injectors (51, 52, 53, 54, 55, 56), programmable and previously entered in the computer-programmable controller element;

(f) moving the pintle (20) in a linear direction, from a position of extraction, to allow the sheet (S) to be positioned in the delivery position, and to an inserted position, wherein the pintle (20) is inserted into a slot (33), sending an indicative signal from the computer-programmable controller element (70) to a rotary motor (41) of a pintle drive (40) configured to steer the pintle (20);

(g) pressing, the pintle (20) in a linear direction to insertion, a portion of said sheet (S) arranged between the slot (33) and pintle (20) in the delivery position, to the inside of the slot (33), wherein the pintle (20) and the mold (30) form the box by bending and bonding with glue and pressuring different parts of the sheet (S) with others; and (h) moving the pintle (20), to extraction in the opposite direction of insertion, by sending an indicative signal from the computer-programmable controller element (70) to the rotary motor (41) of the pintle drive (40) configured to steer the pintle (20); wherein the moving of the pintle (20) in a linear direction to insertion is initiated by the computer-programmable controller element (70) when the position (P) of the drag element (11) read continuously corresponds to a second position (P2) between the source and delivery positions, with the second position (P2) defined by a programmable input value (P2*x*, TSx) previously entered by a user in the user interface (73); and wherein activating the supplying actuator (61) is initiated again by the computer-programmable controller element (70), in order to supply a sheet (S) after the previous sheet (S), when the position (P) of the drag element (11) corresponds to a third position (P3) between the source position and the second position (P2), with the third position (P3) defined by an input value (P3*x*, T6*x*) entered by a user in said user interface (73).

2. The method according to claim 1, wherein the rotary motor (12) turns in the same direction as the drag element (11), and is connected to an auger flexible transmission element (14) wherein the drag element (11) and another drag element (11) are mounted at opposite ends, by a signal sent from the computer-programmable controller element (70) to said rotary motor (12), moving the two drag elements (11) in the opposite direction of the linear drag direction (T), alternating between the source and delivery positions, synchronizing the moving of the drag element with movement of the other drag element (11) that does not drag sheet (S) from the delivery position to the source position to drag a another sheet.

3. The method according to claim 2, wherein the second position (P2) is defined by an input value corresponding with a second programmable preset position (P2*x*) of the drag element (11), previously entered at the controller element.

4. The method according to claim 3, wherein the third position (P3) is defined by an input value corresponding with a third preset position (P3*x*) of the drag element (11), previously entered at the controller element.

5. The method according to claim 3, further comprising the steps of:

utilizing the rotary motor (12) to move the drag element (11), based on a programmable preset desired speed indicator (Vx), introduced by a user in the user interface (73) prior to receiving a plurality of nonzero selectable speeds, sent from the computer-programmable controller element (70) which indicates signals to a motor speed controller (16) connected to the rotary motor (12);

converting the indicated signals sent by the controller element (70) when the rotary motor (12) a moves the drag element, and continuously reading in the controller element (70) the positions of the drag element (11); and setting the position of the drag element (11) to a source value (P0) after each detection, in a drag element position detector (18), of the drag element (11) at the source position.

6. The method according to claim 3, further comprising the steps of:

utilizing the rotary motor (12) to move the drag element (11), based on a programmable preset desired speed indicator (Vx), introduced by a user in the user interface (73) prior to receiving the plurality of nonzero selectable speeds, sent from the computer-programmable controller element (70) indicative signals to a motor speed controller (16) connected to the rotary motor (12) and to the rotational encoder (13); reading the signals received by the computer-programmable controller element (70) indicating the position of the drag element (11) from the rotational encoder (13).

7. The method according to claim 2, wherein said second position (P2) is defined by an operational value corresponding with a preset complementary time period (TSx), positioning the drag element (11) in said second position (P2) after having in said computer-programmable controller element (70) said preset complementary time period (TSx) of programmable duration, starting to count said preset complementary time period (TSx) after detecting, in said computer-programmable controller element (70), a position of the drag element (11) dragging the sheet (S) or a position at a front or rear of said sheet in a second previous position (P20), intermediate between said source position and said second position (P2).

8. The method according to claim 7, wherein said third position (P3) is defined by an operational value corresponding with a-preset auxiliary time period (T6*x*), positioning the drag element (11) in said third position (P3) after having in said computer-programmable controller element (70) said preset auxiliary time period (T6*x*) of programmable duration, starting to count said preset auxiliary time period (T6*x*) after detecting, in said computer-programmable controller element (70), a position of the drag element (11) dragging the sheet (S) or a position at a front or rear of said sheet in a third previous position (P30), intermediate between said source position and said third position (P3).

9. The method according to claim 2, further comprising the steps of:

(a) detecting a change in the position of the pintle (20) from the position of extraction, receiving an indicative signal sent by a pintle position detector device (2, 8) in the computer-programmable controller element (70) and sending that to the rotary motor (41) and moving the pintle (20) in a linear direction to insertion; and (b) activating the actuators (32) of the forming elements (31), sending an indicative signal from the computer-programmable controller element (70) to the actuators (32), after counting in the controller element (70) for a preset secondary time period (T2*x*) previously entered at the controller element, starting to count the preset secondary time period (T2*x*) after detecting a change in the position of the pintle (20) from the position of extraction.

10. The method according to claim 9, wherein moving the drag element starts again, dragging a sheet (S) to a previous sheet (S), after the computer-programmable controller element (70) counts for a preset time period (T1*x*) of programmable duration previously entered in the controller element, after detecting a change in the position of the pintle (20); and further maintaining one of the drag elements (11) in the delivery position while counting a preset time period (T1*x*) of programmable duration by the computer-programmable controller element.

11. The method according to claim 10, wherein:

the preset time period (T1*x*) begins to count regardless of whether the bending and bonding by the pintle (20) when moving the pintle (20) into the position of insertion or of extraction; and the bending and bonding by pressure and gluing of each of the parts of the sheet to be formed is carried out in its entirety after placing the sheet (S) in the position of delivery when moving the drag element and after activating the actuators (32).

12. The method according to claim 9, further comprising the steps of:

(a) detecting the pintle (20) in the position of insertion, and an indicative signal sent by the pintle position detector device (2, 8) received by the computer-programmable controller element, or reading in the computer-programmable controller element (70) the indicative signal sent by the computer-programmable controller element (70) to the rotary motor (41) when moving the pintle (20) in a linear direction to insertion; and (b) keeping the pintle (20) in the position of insertion by the computer-programmable controller element (70), after detecting the pintle in the position of insertion and for a preset auxiliary time period (T3*x*), previously entered at the controller element, starting to count the preset auxiliary time period (T3*x*) after detecting the pintle (20) in the position of insertion;

wherein the pintle (20) moves to extraction after counting the preset auxiliary time period (T3*x*) in the computer-programmable controller element (70).

13. A machine for forming cardboard boxes (100) by gluing sheets (S), comprising:

a computer-programmable controller element (70);

a user interface (73);

an actuator (61) of a supplying mechanism;

a stacked sheets loader (60);

a drag element (11);

a rotary motor (12);

a mold (30) with a plurality of forming elements (31), each activated by a respective actuator (32), arranged around a slot (33) wherein a pintle (20) is insertable, said pintle (20);

a rotary motor (41) of a pintle drive (40); and glue injectors (51, 52, 53, 54, 55, 56), with the machine (100)-being configured to-execute a method for forming cardboard boxes (B) by gluing in a machine (100) from sheets (S), comprising:

(a) the computer-programmable controller element (70), receiving input values (CP1, CP2, CP3, CP4, CPS, CP6) for a given type and measurements of a box (B) to be formed sent from a user interface (73);

(b) a supplying actuator (61) of a supplying mechanism, activated by the computer-programmable controller element (70), by sending an indicative signal from the computer-programmable controller element (70) to the supplying actuator (61), to supply a sheet (S) from an initial position where it is supported in a stacked sheet loader (60) to a source position;

(c) the drag element (11) moves the sheet (S), sending an indicative signal from the computer-programmable controller element (70) to the rotary motor (12) connected to the drag element (11), in a linear drag direction (T), associated with respective sheet positions (S), from the source position to a delivery position, wherein the sheet (S) is placed between the pintle (20) and the mold (30), with a plurality of forming elements (31), each activatable by a respective actuator (32), arranged around the slot (33) wherein the pintle (20) is insertable;

(d) the position of said drag element (11) associated with the position of the sheet (S) read continuously while moving the drag element, in the computer-programmable controller element (70);

(e) the glue injectors (51, 52, 53, 54, 55, 56), activated to deposit hot-glue cords (50) parallel to each other on the sheet (S) when moving the drag element, sending respective indicative signals from the computer-programmable controller element (70) to each of the glue injectors (51, 52, 53, 54, 55, 56), when the position of the drag element (11) coincides with one or more respective pre-established first positions included in the respective sets of pre-established activation positions (CP1, CP2, CP3, CP4, CPS, CP6), of each of the glue injectors (51, 52, 53, 54, 55, 56), programmable and previously received by the computer-programmable controller element;

(f) the pintle (20) moving in a linear direction, from a position of extraction, to allow the sheet (S) to be positioned in the delivery position, and to an inserted position, wherein the pintle (20) is inserted into the slot (33), sending an indicative signal from the computer-programmable controller element (70) to the rotary motor (41) of the pintle drive (40) configured to steer the pintle (20);

(g) the pintle (20) moving in a linear motion presses a portion of the sheet (S) arranged between the slot (33) and pintle (20) in the delivery position, to the inside of the slot (33), wherein the pintle (20) and the mold (30) form the box by bending and bonding by gluing and pressuring different parts of the sheet (S) with others; and (h) the pintle (20), in the extraction position moves to the insertion position and back, by sending an indicative signal from the computer-programmable controller element (70) to the rotary motor (41) of the pintle drive (40) configured to steer the pintle (20);

wherein linear insertion of the pintle (20) is initiated by the computer-programmable controller element (70) when the position (P) of the drag element (11) read continuously corresponds to a second position (P2) between those source and delivery positions, with the second position (P2) defined by a programmable input value (P2*x*, TSx) previously entered by a user in the user interface (73); and wherein the supplying actuator (61) is initiated again by the computer-programmable controller element (70), in order to supply a sheet (S) after the previous sheet (S), when the position (P) of the drag element (11) read continuously corresponds to a third position (P3) between the source position and the second position (P2), with the third position (P3) defined by an input value (P3*x*, T6*x*) previously entered by a user in the user interface (73).

14. The machine (100) according to claim 13, further including another drag element (11), and an auger flexible transmission element (14), with the machine (100) configured to execute the method further comprising the steps of:

(a) turning the drag element (11) in the same direction as the rotary motor (12) while moving the drag element, which is connected to an auger flexible transmission element (14) where the drag element (11) and another drag element (11) are mounted at mutually opposite ends, by a signal sent from the computer-programmable controller element (70) to the rotary motor (12);

(b) moving the two drag elements (11) in the opposite directions of the linear drag direction (T), alternating between the source and delivery positions, synchronizing with the moving drag element and the other drag element (11) that does not drag sheet (S) from the delivery position to the source position to drag a subsequent sheet.

15. The machine (100) according to claim 13, further including another drag element (11), an auger flexible transmission element (14), and a pintle position detector device (2, 8), with the machine (100) configured to execute the steps of:

(a) detecting a change in the position of the pintle (20) from the position of extraction, receiving in the computer-programmable controller element (70) an indicative signal sent by a pintle position detector device (2, 8) or reading in the computer-programmable controller element (70) the indicative signal sent by the computer-programmable controller element (70) to the rotary motor (41) while moving the pintle (20) in a linear direction to insertion; and (b) activating the actuators (32) of the forming elements (31), sending an indicative signal from the computer-programmable controller element (70) to the actuators (32), after counting in the controller element (70) a preset secondary time period (T2*x*) of programmable duration previously received by the controller element, starting to count the preset secondary time period (T2*x*) after detecting a change in the position of the pintle (20) from the position of extraction.

16. The machine (100) according to claim 13, further including another drag element (11), and an auger flexible transmission element (14), with the machine (100) configured to execute the method wherein, additionally, the second position (P2) is defined by an input value corresponding with the second programmable preset position (P2*x*) of the drag element (11), previously received by the computer-programmable controller element; and wherein additionally the third position (P3) is defined by an input value corresponding with the third preset position (P3*x*) of the drag element (11), previously received by the computer-programmable controller element.

17. The machine (100) according to claim 13, further including another drag element (11), and an auger flexible transmission element (14), with the machine (100) configured to execute the method wherein, additionally, the second position (P2) is defined by an input value corresponding with the second programmable preset position (P2*x*) of the drag element (11), by the computer-programmable controller element.

18. A computer program comprising instructions for a box-forming machine (100) to execute a method for forming cardboard boxes (B) by gluing in the vox-forming machine (100) from sheets (S), comprising:

(a) a computer-programmable controller element (70), receiving input values (CP1, CP2, CP3, CP4, CPS, CP6) for a given type and measurements of a box (B) to be formed sent from the user interface (73);

(b) a supplying actuator (61) of a supplying mechanism, activated by a computer-programmable controller element (70), by sending an indicative signal from the computer-programmable controller element (70) to the supplying actuator (61), to supply a sheet (S) from an initial position where it is supported in a stacked sheet loader (60) at the source position;

(c) a drag element (11) to drag the sheet (S), sending an indicative signal from the computer-programmable controller element (70) to the rotary motor (12) connected to the drag element (11), in a linear direction (T), associated with respective sheet positions (S), from the source position to a delivery position, where the sheet (S) is placed between the pintle (20) and the mold (30), with a plurality of forming elements (31), each activated by a respective actuator (32), arranged around the slot (33) where the pintle (20) is insertable;

(d) the drag element (11) associated with the position of the sheet (S) whose position is continuously read by the computer-programmable controller element when moving the drag element, in the computer-programmable controller element (70);

(e) the glue injectors (51, 52, 53, 54, 55, 56), activated to deposit hot-glue cords (50) parallel to each other on the sheet (S) when moving the drag element, sending respective indicative signals from the computer-programmable controller element (70) to each of the glue injectors (51, 52, 53, 54, 55, 56), when the position of the drag element (11) coincides with one or more respective pre-established first positions included in the respective sets of pre-established activation positions (CP1, CP2, CP3, CP4, CPS, CP6), of each of the glue injectors (51, 52, 53, 54, 55, 56), previously received at the computer-programmable controller element;

(f) the pintle (20) moving in a linear direction, from the position of extraction, to allow the sheet (S) to be positioned in the delivery position, and to the inserted position, where the pintle (20) is inserted into the slot (33), sending an indicative signal from the computer-programmable controller element (70) to the rotary motor (41) of the pintle drive (40) configured to steer the pintle (20);

(g) the pintle (20) pressing in a linear direction a portion of the sheet (S) to the insertion position arranged between the slot (33) and pintle (20) in the delivery position, to the inside of the slot (33), wherein the pintle (20) and the mold (30) form the box by bending and bonding by gluing and pressuring different parts of the sheet (S) with others; and (h) the pintle (20), extracting in the opposite direction of insertion, from the position of insertion to the position of extraction, by sending an indicative signal from the computer-programmable controller element (70) to a rotary motor (41) of a pintle drive (40) configured to steer the pintle (20);

wherein the pintle (20) moves in a linear direction initiated by the computer-programmable controller element (70) when the position (P) of the drag element (11) corresponds to a second position (P2) between the source and delivery positions, with the second position (P2) defined by an input value (P2*x*, TSx) previously entered by a user in the user interface (73); and wherein the activating of the supplying actuator (61) is initiated again by the computer-programmable controller element (70), in order to supply a sheet (S) after the previous sheet (S), when the position (P) of the drag element (11) corresponds to the third position (P3) between the source position and the second position (P2), with the third position (P3) defined by an input value (P3*x*, T6*x*) previously entered by a user in the user interface (73).

19. The computer program according to claim 18, further including instructions for the box-forming machine (100) to execute the method, further comprising the steps of:

turning the rotary motor (12) in the same direction as the moving drag element, which is connected to an auger flexible transmission element (14) where the drag element (11) and another drag element (11) are mounted at opposite ends, by a signal sent from the computer-programmable controller element (70) to the rotary motor (12); and moving the two drag elements (11) in the opposite direction of the linear drag direction (T), alternating between the source and delivery positions, synchronizing the moving of the drag element with movement of the other drag element (11) that does not drag sheet (S) from the delivery position to the source position to drag a subsequent sheet.

20. The computer program according to claim 18, further including instructions for the box-forming machine (100) to execute the method, further comprising the steps of:

(k) detecting a change in the position of the pintle (20) from the position of extraction, receiving in the computer-programmable controller element (70) an indicative signal sent by the pintle position detector device (2, 8) or reading in the computer-programmable controller element (70) the indicative signal sent by the computer-programmable controller element (70) to the rotary motor (41) when moving the pintle (20) in a linear direction to insertion; and (l) activating the actuators (32) of the forming elements (31), sending an indicative signal from the computer-programmable controller element (70) to the actuators (32), after counting in the controller element (70) for a preset secondary time period (T2*x*) of programmable duration previously entered at the computer-programmable controller element, starting to count the preset secondary time period (T2*x*) after detecting a change in the position of the pintle (20) from the position of extraction.

21. The computer program according to claim 18, further including instructions for the machine (100), further including another drag element (11), and an auger flexible transmission element (14), to execute the method further comprising the steps of:

turning the rotary motor (12) in the same direction as the drag element, which is connected to an auger flexible transmission element (14) where the drag element (11) and another drag element (11) are mounted at opposite ends, by a signal sent from the computer-programmable controller element (70) to the rotary motor (12); and moving the two drag elements (11) in the opposite directions of the linear drag direction (T), alternating between the source and delivery positions, synchronizing the movement of the drag element with the movement of the other drag element (11) that does not drag sheet (S) from the delivery position to the source position to drag a subsequent sheet;

wherein, additionally, the second position (P2) is defined by an input value corresponding with a second programmable preset position (P2*x*) of the drag element (11), previously received at the computer-programmable controller element.

22. The computer program according to claim 18, further including instructions for the machine (100), another drag element (11), and an auger flexible transmission element (14), to execute the method further comprising the steps of:

turning the rotary motor (12) in the same direction as the drag element, which is connected to an auger flexible transmission element (14) the drag element (11) and another drag element (11) are mounted at opposite ends, by a signal sent from the computer-programmable controller element (70) to the rotary motor (12), moving the two drag elements (11) in the opposite direction of the linear drag direction (T), alternating between the source and delivery positions, synchronizing with moving the drag element with the movement of the other drag element (11) that does not drag sheet (S) from the delivery position to the source position to drag a subsequent sheet;

wherein, additionally, the second position (P2) is defined by an input value corresponding with a second programmable preset position (P2*x*) of the drag element (11); and wherein additionally the third position (P3) is defined by an input value corresponding with the third preset position (P3*x*) of the drag element (11), previously received at the computer-programmable controller element.

23. A computer-readable device that has a stored computer program comprising instructions for a box-forming machine (100) to execute a method for forming cardboard boxes (B) by gluing in a box-forming machine (100) from sheets (S), comprising the steps of:

(a) receiving, in the computer-programmable controller element (70), operational values (CP1, CP2, CP3, CP4, CPS, CP6) for a given type and measurements of a box (B) to be formed, sent from a user interface (73);

(b) activating the supplying actuator (61) of a supplying mechanism, by the computer-programmable controller element (70), by sending an indicative signal from the computer-programmable controller element (70) to the supplying actuator (61), to supply the sheet (S) from an initial position where it is supported in the stacked sheet loader (60) by the source position;

(c) moving the drag element (11) to drag the sheet (S), sending an indicative signal from the computer-programmable controller element (70) to the rotary motor (11) connected to the drag element (11), in a linear drag direction (T), associated with respective sheet positions (S), from the source position to the delivery position, where the sheet (S) is placed between the pintle (20) and the mold (30), with the plurality of forming elements (31), each activatable by the respective actuator (32), arranged around the slot (33) where the pintle (20) is insertable;

(d) reading the position of the drag element (11) associated with the position of the sheet (S) continuously during said moving a drag element, in the computer-programmable controller element (70);

(e) activating glue injectors (51, 52, 53, 54, 55, 56), to deposit hot-glue cords (50) parallel to each other on the sheet (S) when moving the drag element, sending respective indicative signals from the computer-programmable controller element (70) to each of the glue injectors (51, 52, 53, 54, 55, 56), when the position of the drag element (11) coincides with one or more respective pre-established first positions included in the respective sets of pre-established activation positions (CP1, CP2, CP3, CP4, CPS, CP6), of each of these glue injectors (51, 52, 53, 54, 55, 56), programmable and previously received by the computer-programmable controller element;

(f) moving the pintle (20) in a linear direction to insertion, from the position of extraction, to allow the sheet (S) to be positioned in the delivery position, and to the inserted position, where the pintle (20) is inserted into the slot (33), sending an indicative signal from the computer-programmable controller element (70) to the rotary motor (41) of the pintle drive (40) configured to steer the pintle (20);

(g) pressing a portion of the sheet (S) by the pintle (20) in a linear direction to insertion arranged between the slot (33) and pintle (20) in the delivery position, to the inside of the slot (33), where the pintle (20) and the mold (30) form the box by bending and bonding by gluing and pressuring different parts of the sheet (S) with others; and (h) moving the pintle (20), in the opposite direction of insertion to the position of extraction, by sending an indicative signal from the computer-programmable controller element (70) to the rotary motor (41) of the pintle drive (40) configured to steer the pintle (20);

wherein the pintle (20) moves in a linear direction to the position of insertion initiated by the computer-programmable controller element (70) when the position (P) of the drag element (11) corresponds to the second position (P2) between the source and delivery positions, with the second position (P2) defined by a programmable input value (P2*x*, TSx) previously entered by a user in the user interface (73); and wherein activating the supplying actuator (61) is initiated again by the computer-programmable controller element (70), in order to supply the sheet (S) after the previous sheet (S), when the position (P) of the drag element (11) corresponds with the third position (P3) between the source position and the second position (P2), with the third position (P3) defined by an input value (P3*x*, T6*x*) previously entered by a user in the user interface (73).

24. The computer-readable device according to claim 23, wherein the computer-readable device is a programmable logic controller, corresponding with the computer-programmable controller element (70).

* * * * *